US005361905A

United States Patent [19]

McQueeny et al.

[11] Patent Number: 5,361,905

[45] Date of Patent: Nov. 8, 1994

[54] FLEXIBLE PACKAGING WITH CENTER OPENING FEATURE

[75] Inventors: Thomas P. McQueeny, Chicago, Ill.; Steven C. Gehling, Oshkosh, Wis.; William R. Newman, Neenah, Wis.; John E. Theobald, Appleton, Wis.; Paul Y. Yee, Neenah, Wis.

[73] Assignee: Kimberly-Clark Corporation, Neenah, Wis.

[21] Appl. No.: 125,446

[22] Filed: Sep. 22, 1993

[51] Int. Cl.[5] ..... B65D 75/00; B65B 63/00

[52] U.S. Cl. ..... 206/494; 206/499; 383/8; 383/207

[58] Field of Search ..... 206/494, 812, 499; 383/8, 7, 10, 207, 209, 210

[56] References Cited

U.S. PATENT DOCUMENTS

| | | | |
|---|---|---|---|
| 2,448,819 | 9/1948 | Mitchell . | |
| 2,478,412 | 8/1949 | McMahan . | |
| 2,651,409 | 9/1953 | Fay . | |
| 2,967,610 | 1/1961 | Ebert et al. | 206/494 |
| 2,998,911 | 9/1961 | Hahn et al. . | |
| 3,012,692 | 12/1961 | Petersen . | |
| 3,090,483 | 5/1963 | Altree et al. | 206/494 |
| 3,124,298 | 3/1964 | Repko . | |
| 3,161,336 | 12/1964 | Loescher . | |
| 3,162,353 | 12/1964 | Sylvester et al. . | |
| 3,174,644 | 3/1965 | Kaltman et al. . | |
| 3,227,359 | 1/1966 | Hanlon . | |
| 3,826,361 | 7/1974 | Heckrodt . | |
| 4,062,486 | 12/1977 | Goodrich . | |
| 4,175,673 | 11/1979 | McDonald et al. . | |
| 4,252,269 | 2/1981 | Peppiatt . | |
| 4,328,655 | 5/1982 | Spencer et al. . | |
| 4,460,088 | 7/1984 | Rugenstein et al. . | |
| 4,487,318 | 12/1984 | Roen . | |
| 4,539,705 | 9/1985 | Baines . | |
| 4,540,091 | 9/1985 | Habock . | |
| 4,550,439 | 10/1985 | Peppiatt et al. . | |
| 4,557,385 | 12/1985 | Robinson . | |
| B14,573,203 | 4/1989 | Peppiatt . | |
| 4,633,649 | 1/1987 | Gautier et al. . | |
| 4,685,276 | 8/1987 | Kiel . | |

(List continued on next page.)

FOREIGN PATENT DOCUMENTS

| | | | |
|---|---|---|---|
| 0425008A1 | 5/1991 | European Pat. Off. . | |
| 1496589 | 9/1967 | France | 383/8 |
| 3629563A1 | 2/1988 | Germany . | |
| 3642327A1 | 2/1988 | Germany . | |
| 9109154.3 | 10/1991 | Germany . | |

(List continued on next page.)

*Primary Examiner*—Bryon P. Gehman
*Attorney, Agent, or Firm*—Paul Yee

[57] ABSTRACT

A package, which can be substantially hexahedral, is composed of a flexible polymer material and contains a plurality of articles. The package includes a front face wall, a back face wall, a top wall, a bottom wall and two oppositely located end walls. A plurality of stacks of the articles are contained within the package, and the article stacks arranged to extend in a generally parallel, side-by-side configuration with each stack including a multiplicity of the articles. Each of the stacks is aligned along an appointed stacking direction of the package, and each of the stacks has opposed facing ends thereof contacting opposed walls of the package. A designated opening mechanism extends across a selected primary opening wall of the package and extends across at least a portion of each of a pair of oppositely located, complementary opening walls of the package. The opening mechanism provides for a selected separation of the primary and complementary opening walls, and is positioned at a location which may be substantially between a pair of separable immediately adjacent arrays of stacked articles, thereby providing for a separation of the package into at least a pair of subpackages, with each subpackage containing at least a portion of at least one article stack therein while exposing a side portion of the at least one article stack for grasping.

22 Claims, 13 Drawing Sheets

U.S. PATENT DOCUMENTS 4,691,368 9/1987 Roessiger .
4,713,839 12/1987 Peppiatt .
4,715,635 12/1987 Koskinen .
4,717,262 1/1988 Roen et al. .
4,721,396 1/1988 Sengewald .
4,730,942 3/1988 Fulcher .
4,730,943 3/1988 Johnson .
4,738,546 4/1988 Sengewald .
4,838,429 6/1989 Fabisiewicz et al. .
4,867,575 9/1989 Wood .
4,874,255 10/1989 Ball et al. .
4,874,256 10/1989 Baines .
4,877,335 10/1989 Barnard .
4,877,336 10/1989 Peppiatt .
4,934,535 6/1990 Muckenfuhs et al. .
4,966,286 10/1990 Muckenfuhs .
5,036,978 8/1991 Frank et al. .
5,050,742 9/1991 Muckenfuhs .
5,054,619 10/1991 Muckenfuhs .

FOREIGN PATENT DOCUMENTS 2035258A 6/1980 United Kingdom .
2264278A 8/1993 United Kingdom .
WO92/18396 10/1992 WIPO .
WO93/16925 9/1993 WIPO .
WO93/16929 9/1993 WIPO .

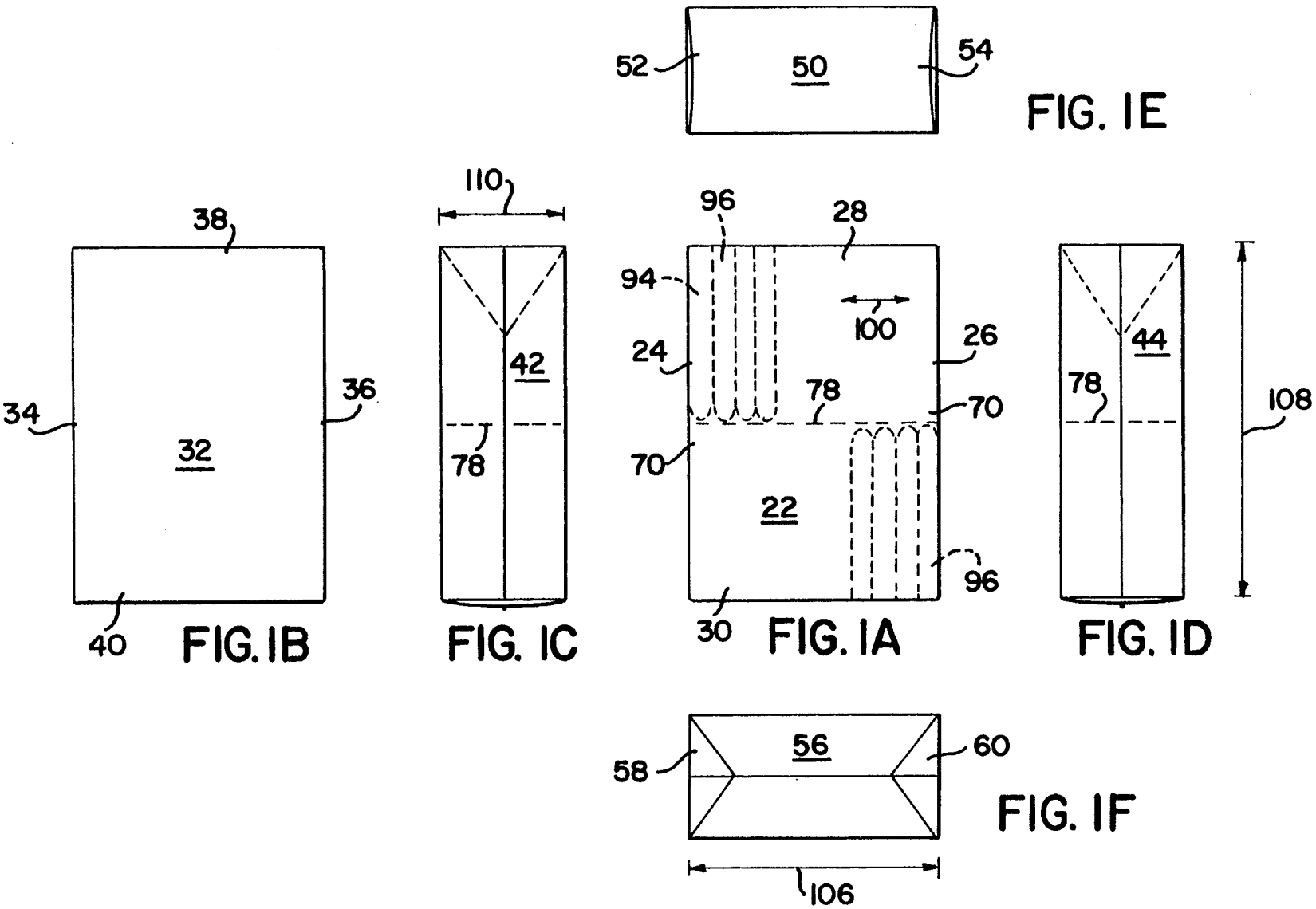
FIG. IE
FIG. ID
FIG. IA
FIG. IF
FIG. IC
FIG. IB
50
52
54
44
78
108
26
70
96
28
100
78
22
96
94
24
70
30
56
58
60
106
42
78
110
32
34
36
38
40

20
22
70
70
44
56

32
50
70
44

22
70
70
44
42

92
92
74
84
76

100
96
96a
94
94

FLEXIBLE PACKAGING WITH CENTER OPENING FEATURE

FIELD OF THE INVENTION

The present invention relates to flexible packaging which contains a plurality of selected articles, such as disposable diapers, training pants, feminine care products, incontinence garments or the like. More particularly, the present invention relates to a flexible package having an improved center opening feature which facilitates access to contained articles arranged in an array of multiple stacks.

BACKGROUND OF THE INVENTION

Bag packages composed of flexible polymer materials have been used for packaging various types of products, such as infant diapers, feminine care products and adult incontinence garments. The bags allow a packaging of the articles to create a carton-like look and configuration which facilitates transportation and display on retail shelves. The bags typically include handles to facilitate the carrying of individual packages from the retail shelves, and can include mechanisms for providing an access opening through the top and end panels of the package.

For example, U.S. Pat. 4,252,269 issued Feb. 24, 1981, to H. Peppiatt describes a bag of polymeric plastic material which has an opening at one end and a gusset at the opposite end. Within the gusset there is disposed a handle welded to front and rear panels of the bag along a fold line. The handle is shorter than the length of the gusset.

U.S. Pat. No. B1 4,573,203 (Reexamination Certificate) issued Apr. 18, 1989 patent issued Feb. 25, 1986) to H. Peppiatt describes a reusable plastic bag with a loop handle. The bag is for packaging goods in a sealed manner with perforations being provided to facilitate access to the goods without interfering with the reusability of the bag.

A number of flexible bag designs have incorporated a mechanism which opens a predetermined portion of a tensioned side panel of the bag, without releasing the tension in the remainder of the side panel. For example, see U.S. Pat. Nos. 5,036,978 issued Aug. 6, 1991, to M. Frank et al.; 4,934,535 issued June 1990 to Muckenfuhs et al.; 4,966,286 issued October 1990 to Muckenfuhs; 5,050,742 issued Sep. 24, 1991, to D. Muckenfuhs; and 5,054,619 issued Oct. 8, 1991, to D. Muckenfuhs.

Conventional plastic bags, such as those described above, however, have not provided the desired combination of convenient portability and a substantially interference-free access to the packaged articles through the top of the bag. The relatively large openings in the end panels of the package can too easily allow articles to fall out of the partially emptied package. In addition, the opening at the end panel can make it more difficult to use the partially filled package as a temporary carrier for accessory, personal care articles.

BRIEF DISCLOSURE OF THE INVENTION

One aspect of the present invention provides a package which is composed of a flexible polymer material and contains a plurality of articles. The package includes a front face wall defining a top edge region, a bottom edge region and two opposed side edge regions thereof, and a back face wall defining a top edge region, a bottom edge region and two opposed side edge regions thereof. A top wall interconnects between the top edge regions of the front and back face walls, and includes a pair of oppositely located side edge regions thereof. A bottom wall interconnects between the bottom edge regions of the front and back face walls and includes a pair of oppositely located side edge regions thereof. Two oppositely located end walls are each interconnected between a side edge region of said front face wall and a side edge region of the back face wall, and are each interconnected between a side edge region of the top wall and a side edge region of the bottom wall. A plurality of stacks of the articles are contained within said package, and the article stacks arranged to extend in a generally parallel, side-by-side configuration with each stack including a multiplicity of the articles. A designated opening means extends across a selected primary opening wall of the package and extends across at least a portion of each of a pair of oppositely located, complementary opening walls of the package. The opening means provides for a selected separation of the primary and complementary opening walls, and is positioned along the primary and complementary opening walls at a location which is substantially between a pair of separatable stacked arrays of the articles, thereby providing for a separation of the package into at least a pair of subpackages, with each subpackage containing at least a portion of at least one article stack therein while exposing a side portion of the at least one article stack.

Another aspect of the invention provides a bag composed of a flexible polymer material for holding a plurality of articles. The bag includes a bag front panel which defines a top edge region, a bottom edge region, and two opposed side edge regions thereof. A bag back panel defines a top edge region, a bottom edge region, and two opposed side edge regions thereof which connect to the side edge regions of the front panel. A bag gusset panel interconnects between the top edge regions of the front and back panels. A designated opening means extends at least partially across one of the front and back panels and continues therefrom to extend at least partially across the other of the front and back panels. The opening means provides for a selected separation of the bag panels and is positioned to provide a dividing line located substantially between separatable, adjacent stacked arrays of the articles, thereby providing for a separation of the bag into at least a pair of bag subsections. Each subsection is appointed to thereby contain at least a portion of at least one article stack therein, while exposing a portion of the at least one article stack for grasping.

Yet a further aspect of the invention provides another bag composed of a flexible polymer material for holding a plurality of articles. The bag includes a bag front panel which defines a top edge region, a bottom edge region, and two opposed side edge regions thereof. A bag back panel defines a top edge region, a bottom edge region, and two opposed side edge regions thereof which connect to the side edge regions of the front panel. An opposed pair of bag side gusset panels interconnect between the side edge regions of the front and back panels. A designated opening means extends across at least one of the front and back panels and continues therefrom to extend at least partially across each of the side gusset panels with at least a section of the opening means aligned with the bag stacking direction. The opening means provides for a selected separation of the bag and is positioned along the bag panels at a region of the bag containment portion which is appointed for placement substantially intermediate a pair of separatable, adjacent stacked arrays of the articles, thereby providing for a separation of the bag into at least a pair of appointed bag subsections. Each bag subsection is appointed to contain at least one complete article stack therein, while exposing a side portion of the at least one article stack.

The distinctive containment devices provided by the invention can advantageously provide improved access into a package containing a plurality of articles arranged in two or more article stacks. The package includes an opening mechanism which can expose an extended side edge portion of an article stack which can facilitate the grasping and removal of an individual article from the package.

BRIEF DESCRIPTION OF THE DRAWINGS

The present invention will be more fully understood and further advantages will become apparent when reference is made to the following detailed description of the invention and the accompanying drawings in which:

FIG. 1A representatively shows a front elevational view of a filled package of the invention;

FIG. 1B representatively shows a back elevational view of a filled package of the invention;

FIGS. 1C and 1D representatively show a side elevational views of a filled package of the invention;

FIG. 1E representatively shows a top view of a filled package of the invention;

FIG. 1F representatively shows a bottom view of a filled package of the invention;

DETAILED DESCRIPTION OF THE INVENTION

Figure 2B:
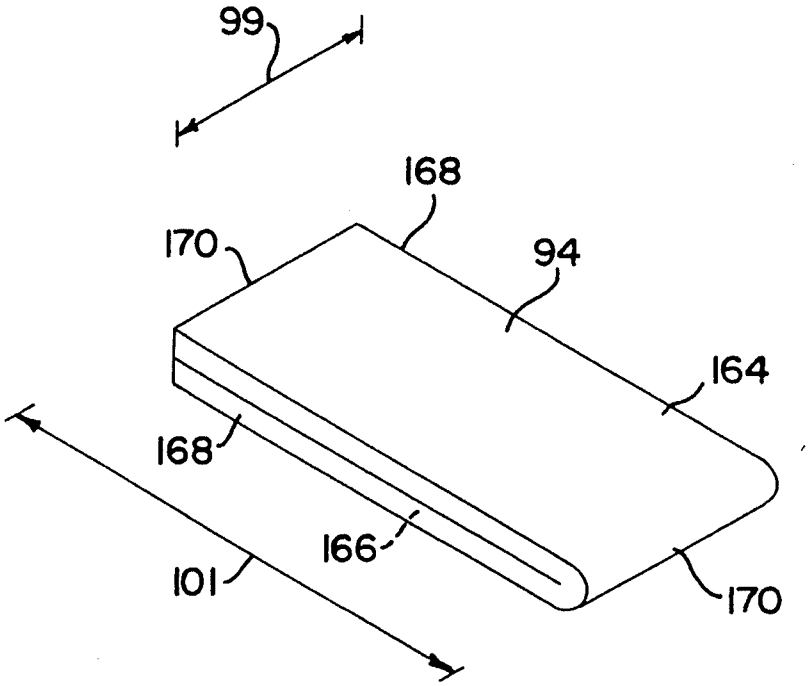
FIG. 2B representatively shows an article which can be arranged in predetermined stacks.

The present invention provides a distinctive package for containing a plurality of selected articles which have been arranged in the configuration of multiple, side-by-side stacks. The package is particularly useful for holding disposable absorbent garments, such as disposable diapers, training pants, feminine care products, incontinence garments and the like. It is readily apparent, however, that the package would be suitable for containing other articles which can be arranged in multiple stacks and formed into a carton-like, hexahedral configuration.

With reference to the embodiment representatively shown in FIGS. 1A through 1F, a package 20 is composed of a flexible polymer material and contains a plurality of articles 94. The package comprises a front face wall 22 which defines a top edge region 28, a bottom edge region 30, and two opposed side edge regions 24 and 26 thereof. A back face wall 32 defines a top edge region 38, a bottom edge region 40, and two opposed side edge regions 34 and 36 thereof. A top wall 50 interconnects between the top edge regions 28 and 38 of the front and back walls 22 and 32, respectively, and includes a pair of oppositely located side edge regions 52 and 54 thereof. A bottom wall 56 interconnects between the bottom edge regions 30 and 40 of the front and back walls 22 and 32, respectively. The bottom wall includes a pair of oppositely located side edge regions 58 and 60 thereof. Two oppositely located end walls 42 and 44 are each interconnected between a side edge region of the front wall and a side edge region of the back wall, and is interconnected between a side edge region of the top wall and a side edge region of the bottom wall. In particular, end wall 42 interconnects between side edge region 24 of front wall 22 and side edge region 36 of back wall 32, and interconnects between side edge region 52 of top wall 50 and side edge region 58 of bottom wall 56. Similarly, end wall 44 interconnects between side edge region 26 of front wall 22 and side edge region 34 of back wall 32, and interconnects between side edge region 54 of top wall 50 and side edge region 60 of bottom wall 56. A plurality of stacks 96 of articles 94 are contained within package 20. The article stacks are arranged to extend in a generally parallel, side-by-side configuration with each of the stacks aligned along an appointed stacking direction 100 of the package. Each of stacks 96 has opposing ends 97 and 98 (FIG. 2A) thereof for contacting opposed walls of the package, thereby identifying the contacted opposed walls as appointed abutment walls of package 20. A designated opening means, such as frangible region 70 (FIG. 1A), extends across a selected primary opening wall of the package, such as front face wall 22 or back face wall 32. The opening means also extends at least partially across each of a pair of oppositely located, complementary opening walls of the package, such as package side panels 42 and 44. The opening means provides for a selected separation of the primary and complementary opening walls and is positioned along the primary and complementary opening walls at a location which is positioned substantially between separatable, adjacent stacked arrays 92 (FIG. 3C) of articles 94, thereby providing for a separation of package 20 into at least a pair of subpackages 74 and 76 (FIG. 3C). Each subpackage contains at least a portion of at least one article stack therein while exposing a portion of the at least one article stack for grasping.

In the illustrated embodiment, for example, each of the package walls is composed of the same flexible polymer material. Optionally, the various individual package walls may be composed of different materials. In the various illustrated embodiments, package 20 has a generally hexahedral shape and defines a package length 106 (FIG. 1F), a package depth 108 (FIG. 1D) and a package width 110 (FIG. 1C).

Figure 2A:
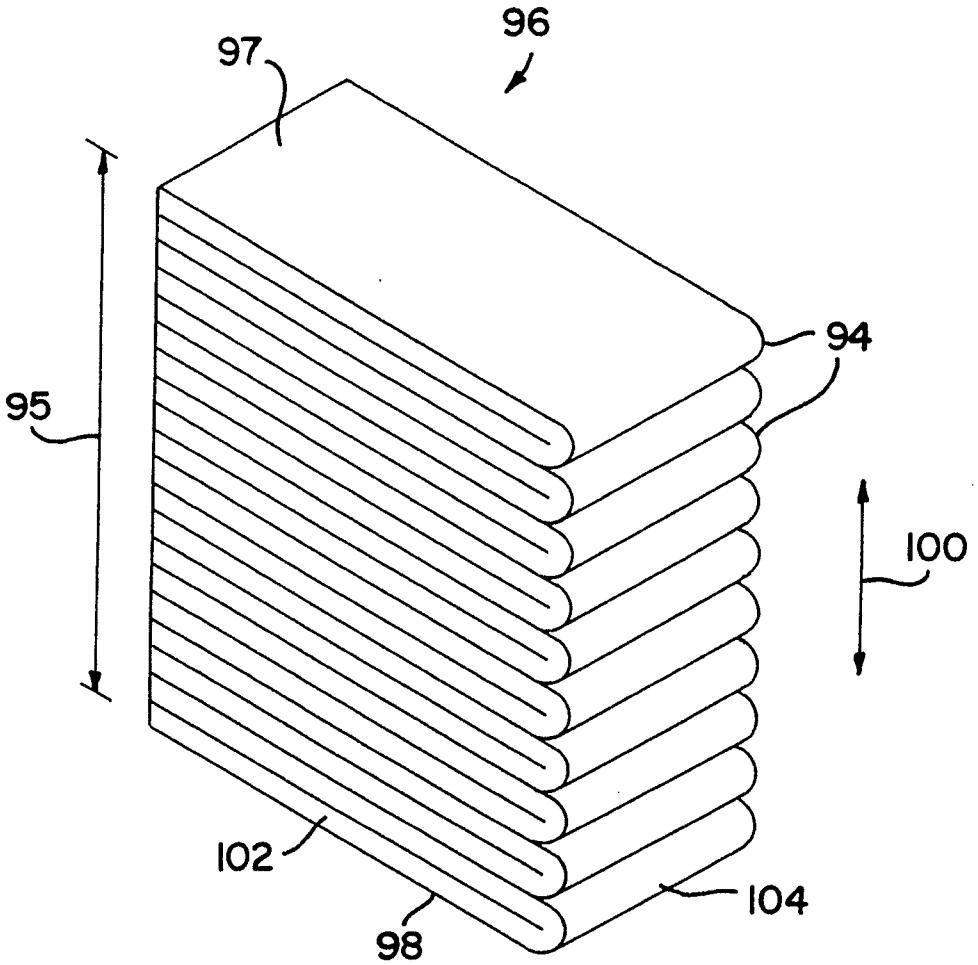
FIG. 2A representatively shows an article stack that can be contained by the present invention.
Figures 3A, 3B, 3C, 3D, 3E:
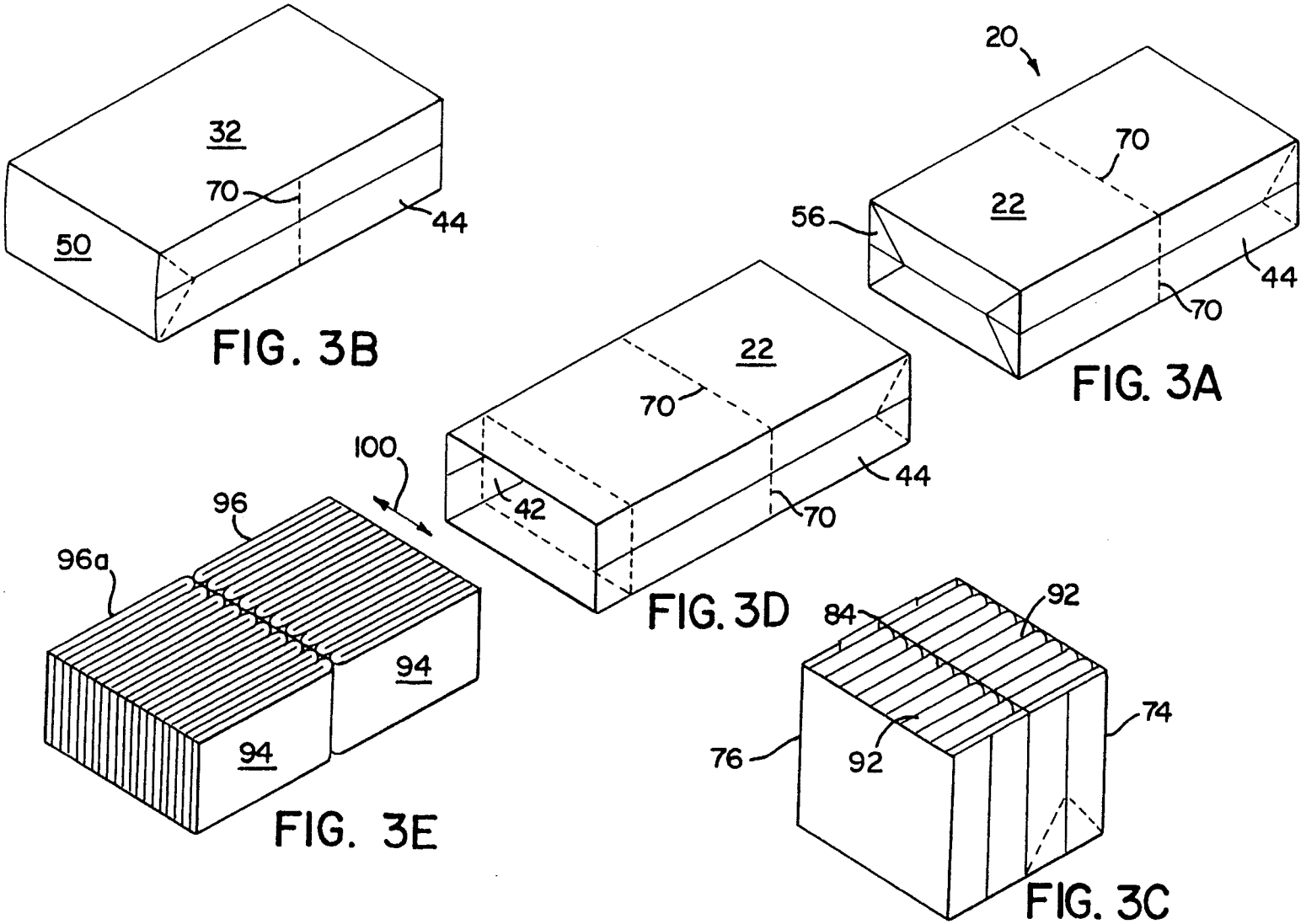
FIG. 3A representatively shows a perspective top view of a package of the invention.
FIG. 3B representatively shows a perspective bottom view of the package of FIG. 3A.
FIG. 3C representatively shows a perspective view of the package of the invention illustrated in FIG. 3A, wherein the package has been separated into a plurality of subpackages.
FIG. 3D representatively shows a bag of the invention prepared to be filled with a plurality of article stacks to form the package of FIG. 3A.
FIG. 3E representatively shows a plurality of article stacks which will be inserted into the bag of FIG. 3D.

With reference to FIGS. 2A and 2B, an individual article stack 96 is composed of a plurality of individual articles 94, and has a generally hexahedral shape. The articles can, for example, be absorbent articles, such as disposable diapers or the like. In the representative embodiment, the articles are folded and provide two opposed face surfaces 164 and 166 and pairs of opposed side edges 168 and 170. The articles are stacked in face-to-face relation and in substantial alignment with one another with the two end-most articles providing the opposed, terminal end faces of the article stack. The end faces of the article stacks contact and press against the appointed abutment walls of the package.

Figures 4A, 4B, 4C, 4D, 4E:
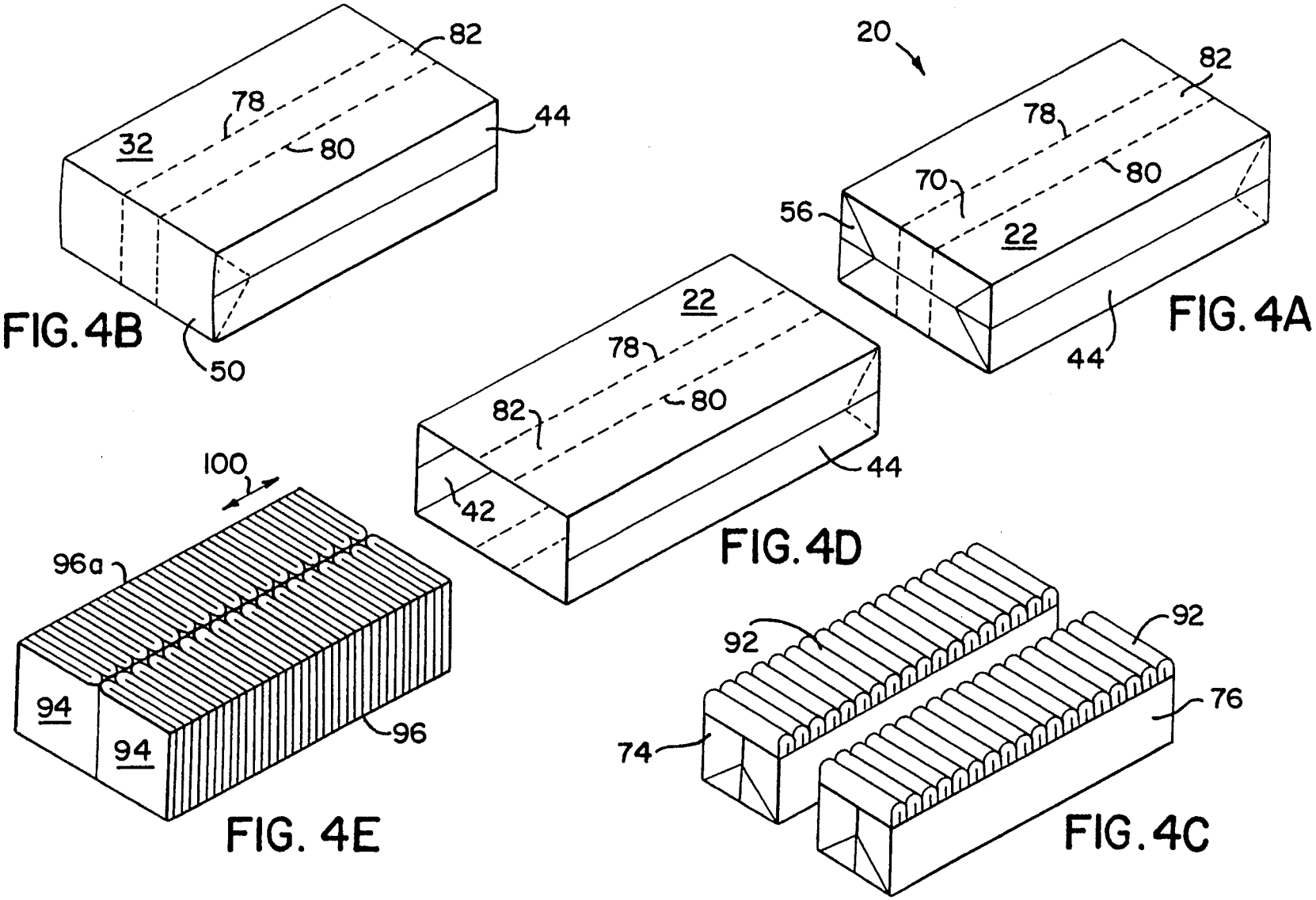
FIG. 4A representatively shows a perspective top view of another package of the invention.
FIG. 4B representatively shows a perspective bottom view of the package of FIG. 4A.
FIG. 4C representatively shows a perspective view of the package of FIG. 4A wherein the package has been separated into a plurality of subpackages.
FIG. 4D representatively shows a bag of the invention prepared to be filled with a plurality of article stacks to form the package of FIG. 4A.
FIG. 4E representatively shows a plurality of article stacks which will be inserted into the bag of FIG. 4D.

A plurality of at least two stacks 96, 96*a* (FIG. 3E) are contained within package 20, and each of the stacks has a predetermined stack length 95 (FIG. 2A). The stacks are preferably positioned in a side-by-side arrangement with the side edges of the articles within one stack positioned beside the side edges of the articles within an immediately adjacent article stack. The stacking direction 100 of the resultant stack array within package 20 can be aligned generally parallel to the length-wise, top edge of package front wall 22 (FIG. 3D). Optionally, the stacking direction 100 of the resultant stack array within package 20 can be aligned generally perpendicular to the top edge of package front wall 22 and generally parallel to the plane defined by front wall 22 (FIG. 4D). Still another configuration can have the stacking direction aligned generally parallel to the top edge of end walls 42 and 44, and generally perpendicular to the plane defined by front face wall 22 (FIGS. 8A through 8E). In particular aspects of the invention, the stack array can be composed of horizontally adjacent article stacks (FIG. 4E), and in other aspects of the invention, the stack array can be composed of vertically adjacent article stacks (FIG. 3E). Optionally, the stack array may be composed of a combination of horizontally and vertically adjacent article stacks (FIG. 8E).

The effective width dimension of the total, complete stacked array can substantially correspond to the extended width dimension of top gusset 150 (FIG. 10C) or side gussets 194, 196 (FIG. 11C) when each of the top or side gussets is spread out in its unfolded, flat-out condition to provide the top wall or end walls, respectively, of package 20.

In the various aspects of the invention, the opening means can include a frangible region 70. The breaking or separating of frangible section 70 may, for example, be provided by partially cutting or otherwise thinning through the thickness of the bag material in a predetermined pattern, providing a selected pattern of perforations along the appointed sections of the bag, providing a desired pattern of stress-fatigue weakening, or the like, located along the appointed sections of the package or bag. In the embodiments wherein the frangible section comprises a frangible line, the frangible line can be provided by a line or other array of perforations which extends across the appointed sections of top wall 50, bottom wall 56, end walls 42 or 44, front wall panel 22 and/or back wall panel 32. In particular embodiments, there can be approximately 2–10 perforations per lineal inch of the frangible line. A shown embodiment, for example, can include a frangible line composed of alternating slits and lands. The slits are approximately $\frac{1}{8}$ inch long and substantially aligned along the intended direction of frangibility. The lands also have a length dimension of approximately $\frac{1}{8}$ inch, as measured along the intended direction of frangibility.

Frangible region 70, in the various aspects of the invention, can include a frangible line provided by a single line of perforations 78 (FIG. 1A). Alternatively, the frangible region may be provided by a system of multiple perforation lines, such as a pair of parallel perforation lines 78 and 80 which generally define a removable strip 82, as representatively shown in FIGS. 4A, 4B and 4D. Strip 82 can, for example, have a width dimension between the perforation lines which is within the range of about 0.25–6 in (about 0.64–15.24 cm). Preferably, the width dimension of strip 82 is within the range of about 1–3 in (about 2.54–7.62 cm), and in the illustrated embodiment the strip width is about 2 in (about 5.08 cm).

Figure 5A:
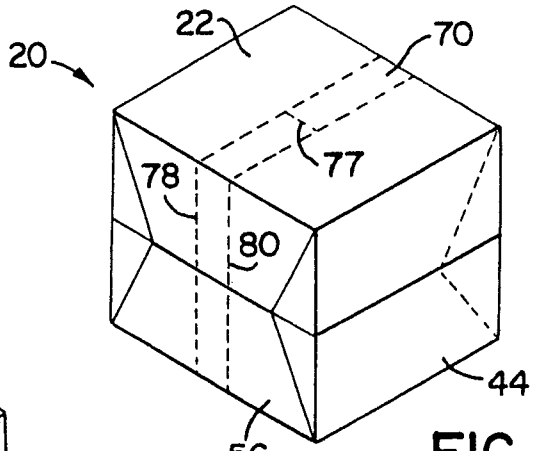
FIG. 5A representatively shows a perspective top view of another package of the invention.
Figure 5B:
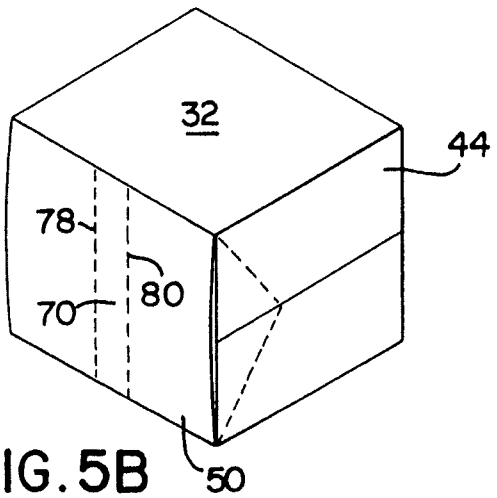
FIG. 5B representatively shows a perspective bottom view of the package of FIG. 5A.
Figure 5D:
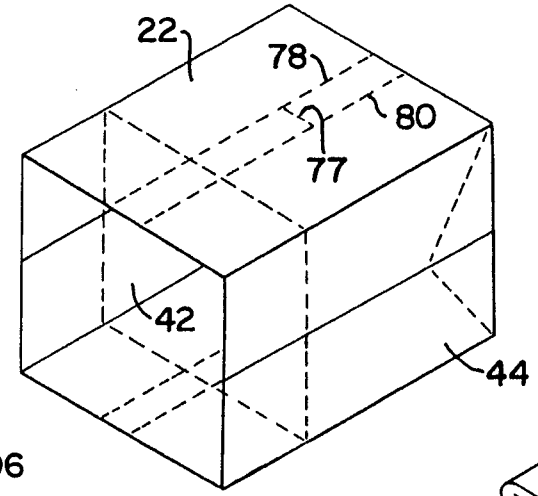
FIG. 5D representatively shows a bag of the invention prepared to be filled with a plurality of article stacks to form the package of FIG. 5A.
Figure 7A:
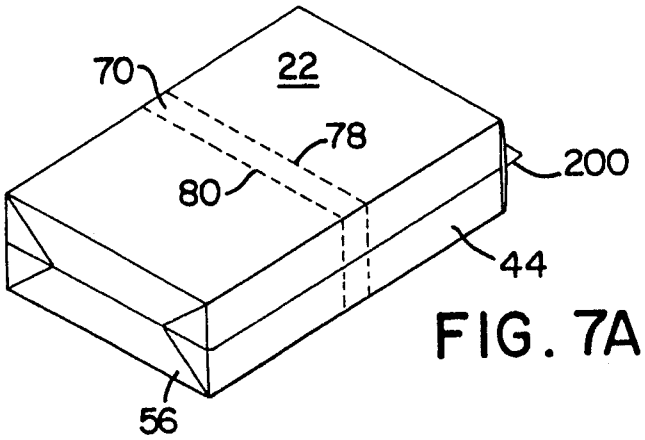
FIG. 7A representatively shows a perspective top view of another package of the invention.
Figure 7C:
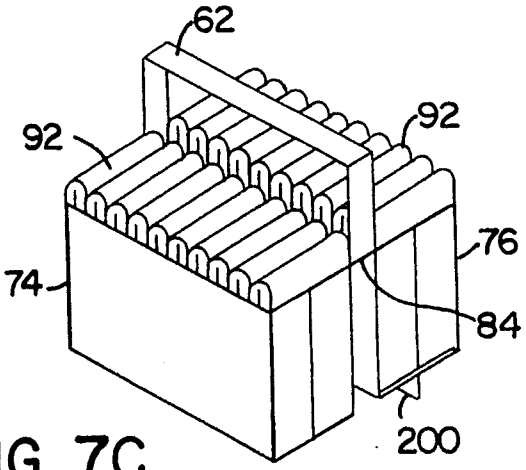
FIG. 7C representatively shows a perspective view of the package of FIG. 7A wherein the package has been separated into a plurality of subpackages.
Figure 7D:
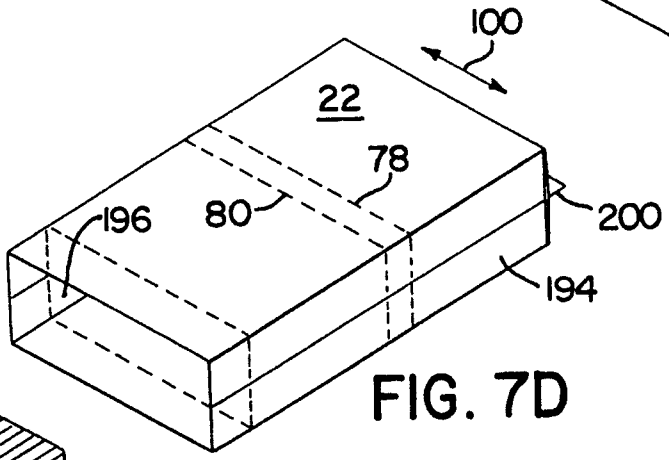
FIG. 7D representatively shows a bag of the invention prepared to be filled with a plurality of article stacks to form the package of FIG. 7A.

In the illustrated embodiment, perforation lines 78 and 80 are substantially coextensive with approximately the same length. Optionally, one of perforation lines 78 or 80 may be longer than the other perforation line. At least a portion of the perforation lines can be configured to extend generally parallel with stacking direction 100 (FIG. 7D). Optionally, the perforation lines can be configured to run substantially perpendicular to stacking direction 100 (FIG. 5D). The various aspects of the invention incorporating a frangible region 70 comprising complementary portions, such as perforation lines 78 and 80, can be configured similar to the aspects of the invention which employ a frangible region 70 composed of a single line of perforations 78.

With reference to FIGS. 3A through 3E, the opening means can be positioned along at least one of the primary and complementary opening walls at a location which is generally parallel to stacking direction 100 and is positioned substantially between a pair of immediately adjacent article stacks 96 and **96*a*, thereby providing for a separation of package 20 into at least a pair of subpackages 74 and 76. Each subpackage contains a stacked array section 92 composed of at least one complete article stack therein, and exposes a side edge portion 102 or 104 (FIG. 2A) of the at least one article stack 96*a* and 96**.

With reference to FIGS. 5A through 5E, the opening means can be positioned along the primary and complementary opening walls at a location which is generally perpendicular to stacking direction 100. When the opening means is activated, the opening means provides a dividing line located substantially between separatable, adjacent stacked arrays 92 of articles 94. In particular, the article stacks 96 become subdivided to form the stacked arrays. The opening means can thereby provide for a desired degree of separation of package 20 into at least a pair of package subsections 74 and 76. Each subsection is appointed to thereby contain at least a portion of at least one article stack therein, while exposing a section, such as the representatively shown intermediate section, of the at least one article stack for grasping.

The embodiment of the invention representatively shown in FIGS. 3A through 3D, for example, incorporates an opening means which extends across a primary opening wall provided by one of the package face walls 22 or 32. The complementary walls are provided by package end walls 42 and 44. The opening means extends along a direction generally parallel to stacking direction 100, and the package end walls are the abutment walls contacted by the opposed facing ends 97 and 98 (FIG. 2A) of the article stacks. In the representatively shown embodiment, the article stacks have a generally hexahedral shape.

In an optional embodiment of the invention, the opening means can include a frangible region which extends across substantially the entire length of front wall 22 and across substantially the entire length of back wall 32. The frangible region contiguously continues therefrom to extend substantially completely across appointed abutment walls provided by end walls 42 and 44. As a result, package 20 can be completely separated into individual, discrete subpackages which are not interconnected to each other. For example, see FIG. 9C.

In another alternative embodiment of the invention, the opening means can include a frangible region which extends across approximately the entire depth of front wall 22 (or alternatively, across approximately the entire depth of back wall 32). The frangible region contiguously continues therefrom to extend across top wall 50 and bottom wall 56. For example, see FIGS. 5A and 5B.

Still other aspects of the invention can include an opening means which extends substantially completely across at least one of the end walls 42 or 44 and continues therefrom to extends across at least a portion of each of the front and back face walls 22 and 32. The opening means thereby provides for a selected separation of the face walls and the at least one end wall, and is positioned along the end and face walls at a location which is intermediate a pair of immediately adjacent stack array sections 92, thereby providing for a separation of the package into at least a pair of subpackages 74 and 76. Each subpackage can contain at least one complete article stack or portions of two or more article stacks. When the package is opened, an appointed section of at least one article stack is exposed for grasping.

Figure 5C:
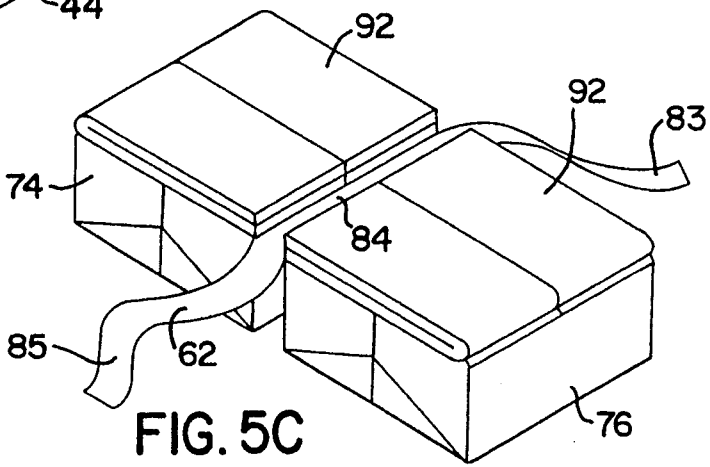
FIG. 5C representatively shows a perspective view of the package of FIG. 5A wherein the package has been separated into a plurality of subpackages.
Figure 5E:
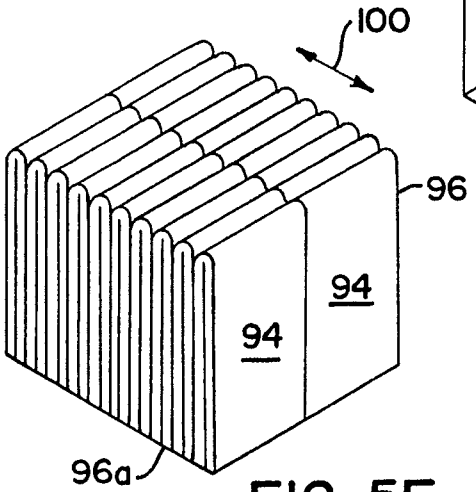
FIG. 5E representatively shows a plurality of article stacks which will be inserted into the bag of FIG. 5D.

With reference to FIG. 5C, for example, stacked array 92 can comprise a portion of each of the article stacks contained within package 20. In the illustrated embodiment, approximately ½ of each individual article stack is located and held within each subpackage 74 and 76.

In a further alternative embodiment, the opening means can include a frangible region which extends across a single, appointed primary opening wall, such as provided by end wall 42 or 44, and continues therefrom to extend across approximately the entire length of front wall 22 and across approximately the entire length of back wall 32. The frangible region is aligned generally parallel to the top edge of front wall 22. Optionally, the opening means can extend across a primary opening wall provided by top wall 50, and can continue therefrom to extend across approximately the entire depth of front wall 22 and across approximately the entire depth of back wall 32. Accordingly, the opening means is aligned generally parallel to the side edges of front wall 22.

In the various configurations of the invention, a section of package 20 can include a portion thereof which provides for a remaining interconnection between subpackages 74, 76. The remaining interconnection can provide a hinge section 84 which allows a convenient opening while also maintaining the general integrity of the packaging or bag system. In the representative embodiment shown in FIG. 3A through 3D, for example, hinge section 84 is located along a length-wise extending section of back face wall 32.

The various aspects of the package and bag of the invention can include a primary carrying handle for hand carrying the filled package or bag. With reference to the embodiment representatively shown in FIG. 6A, for example, primary handle member 200 can include a carrying strap portion 202 and a mounting portion 204. The illustrated embodiment includes a primary handle member 200 having a mounting portion 204 which extends substantially completely around the top edge periphery of package 20. The handle mounting portion is operably connected, such as by thermal bonding, to the top edge regions of front face wall 22, back face wall 32, and end walls 42 and 44. A strap portion 202 of the primary handle member connects to the mounting portion 204 and bridges over the top of package top wall 50 to provide a carrying loop. The carrying loop is constructed to bridge transversely over top wall 50 and to extend between front wall 22 and back wall 32. The carrying loop can be constructed and arranged to provide for an arm suspension of the package 20 from the carrying loop.

Figure 6B:
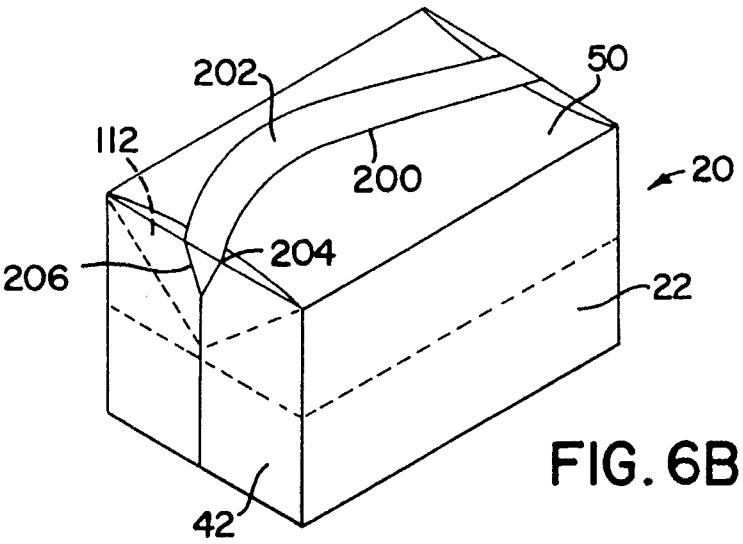
FIG. 6B representatively shows an aspect of the invention having a primary carrying handle which bridges longitudinally over the package and is attached to opposed package end walls.
Figure 6C:
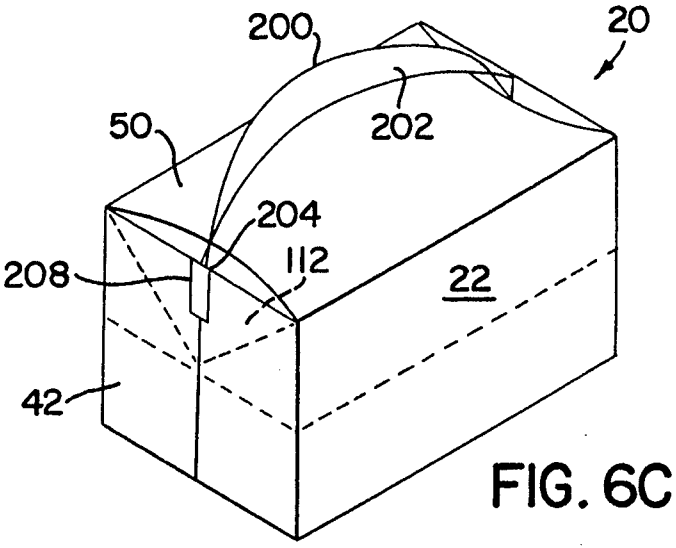
FIG. 6C representatively shows a perspective view of another package having a primary carrying handle which bridges longitudinally over the package; .

With reference to FIGS. 6B and 6C, primary handle member 200 can be configured to bridge over the length-wise dimension of package top wall 50 and connect to package end walls 42 and 44 by suitable attaching means, such as thermal bonding. The primary handle member provides a suitable carrying strap 202, and the strap can be constructed and arranged to provide for an arm suspension of package 20 therefrom. The attachment between the mounting portion of handle member 200 and end walls 42 and 44 may be configured with a chevron-shaped attachment 206, such as representatively shown in FIG. 6B. Alternatively, the mounting portion of the primary handle member may be attached to the end walls with a bar-shaped attachment 208, such as representatively shown in FIG. 6C. In the shown embodiments, handle member 200 is interposed between the individual end wall 42 or 44 and a generally triangular-shaped tuck 112, which is formed and located immediately adjacent to the end wall.

In the various embodiments of the invention, carrying strap 202 may provide two generally opposed loop faces. Each of the loop faces can have at least one hand-grip opening formed therein with the hand-grip openings configured to provide for a hand-suspension of the package. Where frangible region 70 is arranged to traverse a section of the mounting portion of primary handle web 200, the mechanism of frangibility is operably incorporated into the traversed section of the handle web to allow the desired opening of the package.

Figure 7B:
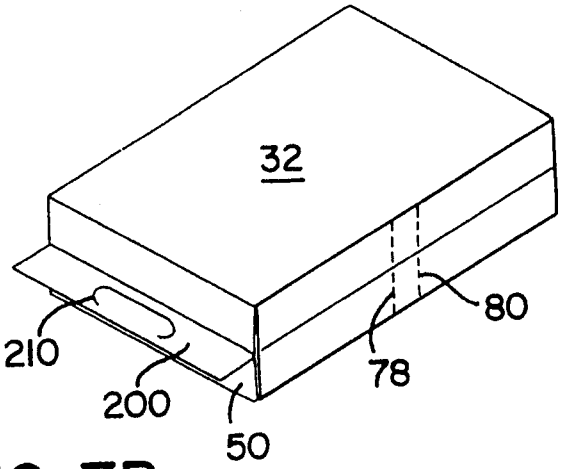
FIG. 7B representatively shows a perspective bottom view of the package of FIG. 7A.
Figure 7E:
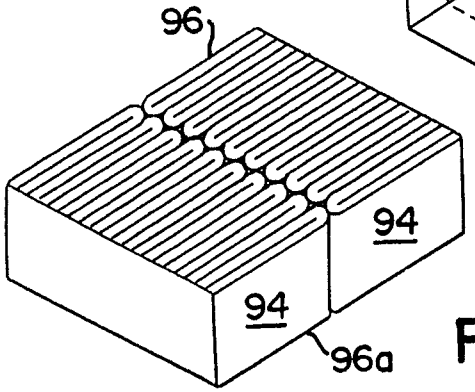
FIG. 7E representatively shows a plurality of article stacks which will be inserted into the bag of FIG. 7D.

With reference to FIGS. 7A through 7D, package 20 can be formed from a bag constructed with two opposed side gusset panels 194 and 196. With this configuration, a primary handle member 200 can be formed integral with the material employed to form package top wall 50 (FIG. 7B). In addition, handle member 200 can be configured with a suitable hand grip opening 210.

Figure 9A:
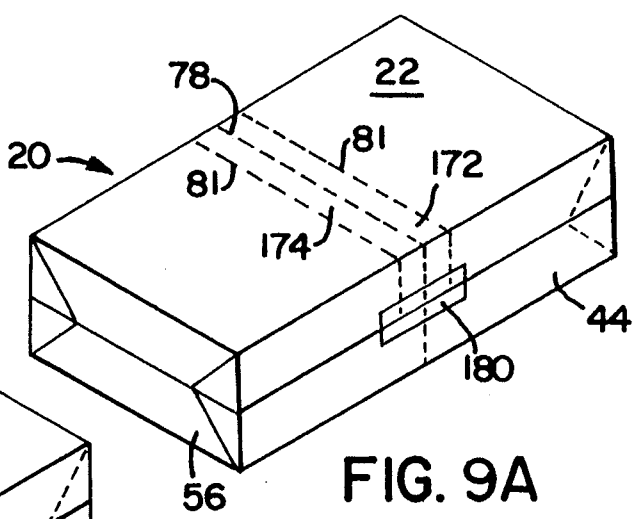
FIG. 9A representatively shows a perspective top view of a package of the invention having a plurality of supplemental handle straps.
Figure 9B:
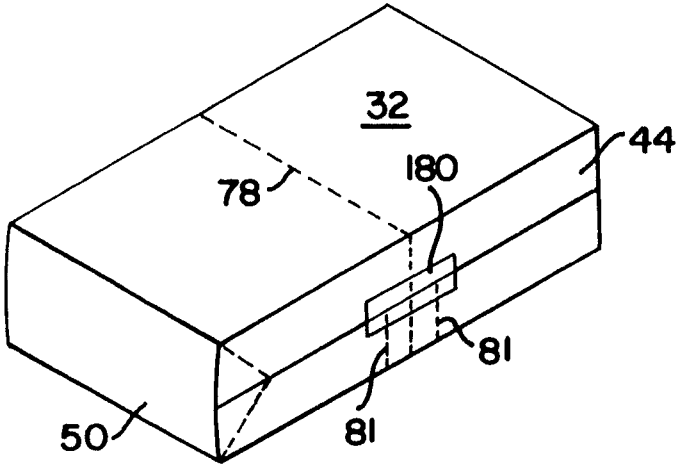
FIG. 9B representatively shows a perspective bottom view of the package of FIG. 9A.
Figure 9C:
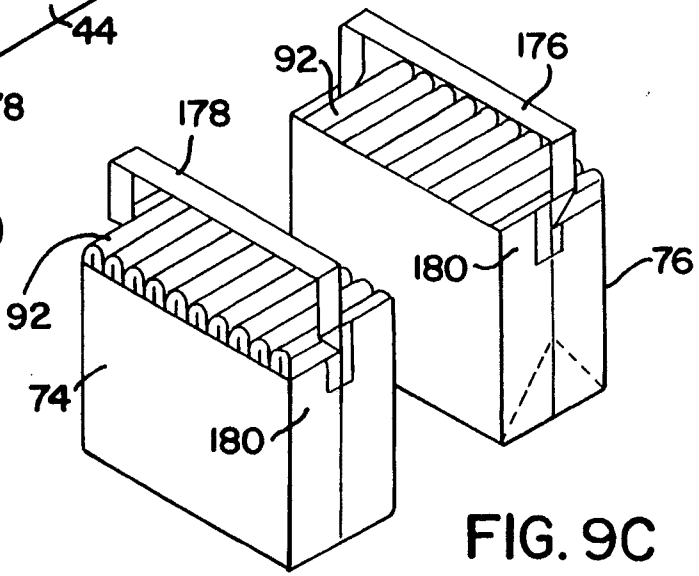
FIG. 9C representatively shows a perspective view of the package of FIG. 9A, wherein the package has been separated into a plurality of subpackages and wherein the supplemental handle straps have been activated to provide a supplemental strap on each subpackage.
Figure 9D:
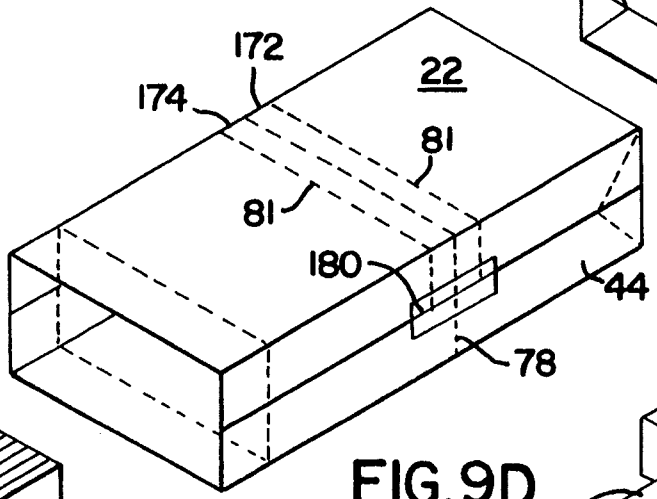
FIG. 9D representatively shows a bag of the invention prepared to be filled with a plurality of article stacks to form the package of FIG. 9A.
Figure 9E:
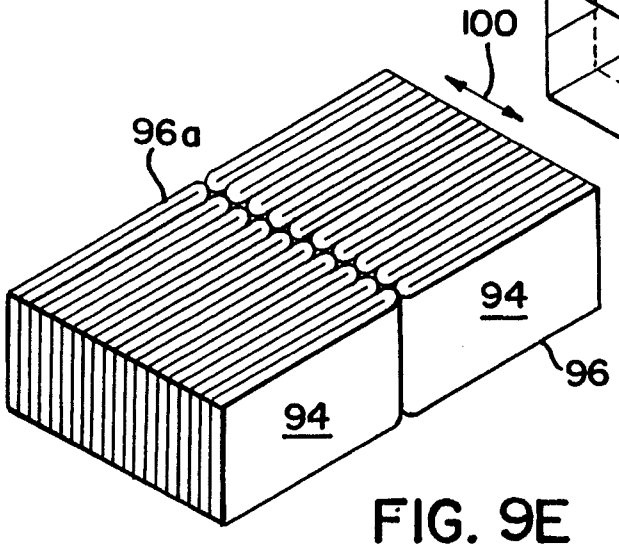
FIG. 9E representatively shows a plurality of article stacks which will be inserted into the bag of FIG. 9D.

Package 20 can further comprise at least one supplemental handle member 62 (FIGS. 5A through 5C), or plurality of supplemental handle members 176 and 178 (FIGS. 9A through 9C). The supplemental handle member is connected to package 20 in a substantially inoperable storage condition, and is activatable to an operable handle condition. In particular aspects of the invention, supplemental handle member is integrally formed with at least one of package front wall 22 or package back wall 32 when the handle member is in its storage condition. In the illustrated embodiments, the supplemental handle member is activated by tearing or otherwise separating away a predetermined section of the package front or back wall.

The various embodiments of the invention which incorporate a frangible region 70 having complementary frangible portions can be configured to provide supplemental handle member 62. For example, with reference to FIGS. 5A through 5C, complementary lines of perforations 78 and 80 can extend substantially completely across a single primary opening wall, such as package front face wall 22, and at least partially across the width of top wall 50 and bottom wall 56. The illustrated embodiment incorporates complementary perforation lines that extend across substantially the entire width of the top and bottom walls. At least a portion of package back face wall 32 is free of frangible region 70, and a transverse line of frangibility such as perforation line 77 interconnects between perforation lines 78 and 80. As a result, frangible region 70 can be separated into a pair of strip sections 83 and 85 which remain connected to package back face wall 32. Subpackages 74 and 76 can be pivoted open about the hinge portion 84 provided by the unseparated section of back face wall 32. If desired, the two strip sections 83 and 85 can then be held together and employed as a package carrying strap for transporting the interconnected pair of subpackages 74 and 76.

Figure 8A:
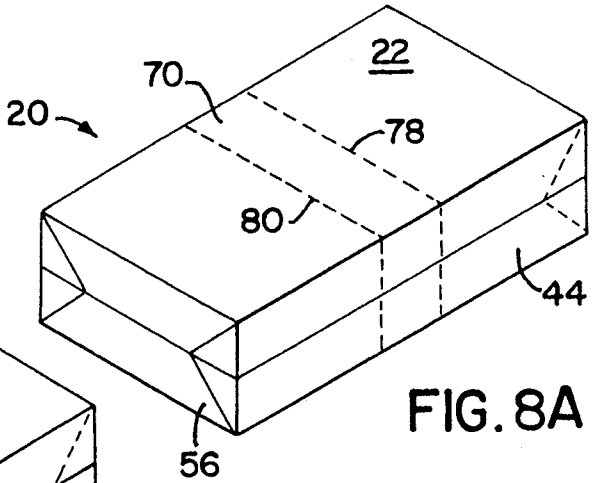
FIG. 8A representatively shows a perspective top view of a package of the invention having a single supplemental handle strap.
Figure 8B:
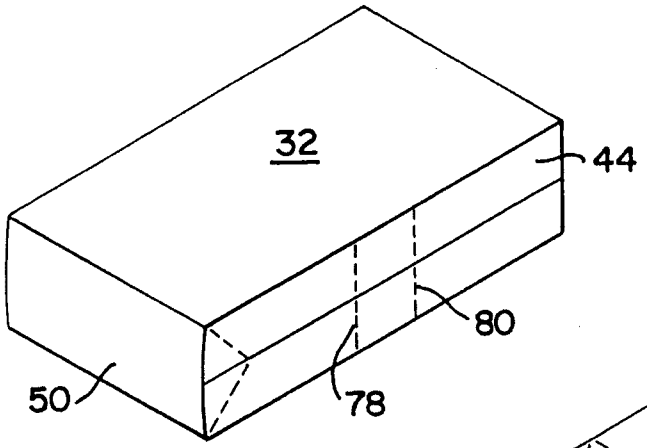
FIG. 8B representatively shows a perspective bottom view of the package of FIG. 8A.
Figure 8C:
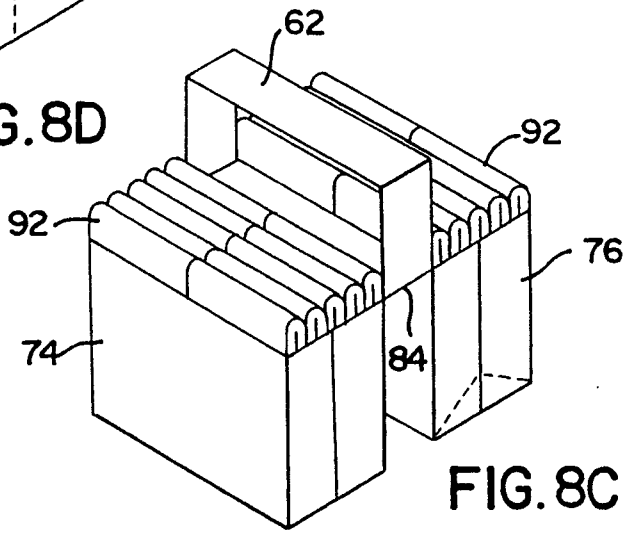
FIG. 8C representatively shows a perspective view of the package of FIG. 8A, wherein the package has been separated into a plurality of subpackages and wherein the supplemental handle strap has been activated.
Figure 8D:
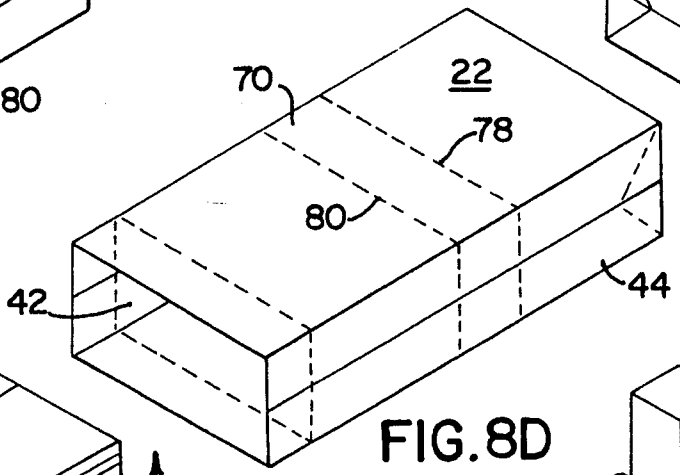
FIG. 8D representatively shows a bag of the invention prepared to be filled with a plurality of article stacks to form the package of FIG. 8A.
Figure 8E:
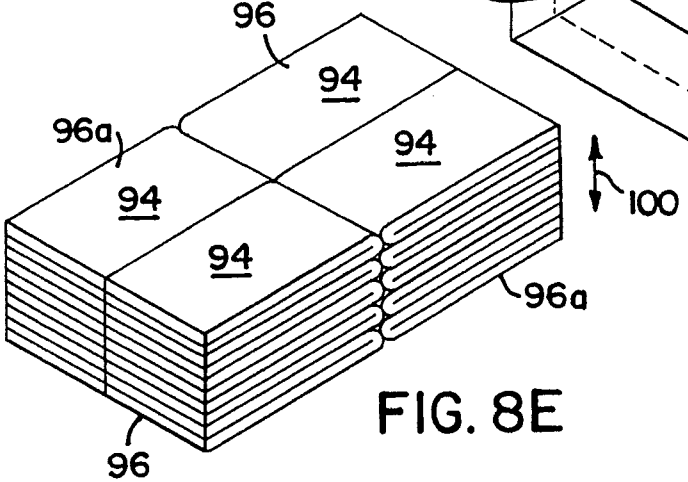
FIG. 8E representatively shows a plurality of article stacks which will be inserted into the bag of FIG. 8D.

In another example representatively shown in FIGS. 8A through 8C, complementary lines of perforations 78 and 80 can extend substantially completely across a single primary opening wall, such as package front face wall 22, and at least partially across the width of end walls 42 and 44. The illustrated embodiment incorporates complementary perforation lines that extend across substantially the entire width of the end walls. At least a portion of package back face wall 32 is free of frangible region 70. As a result, frangible region 70 can be separated to form a single supplemental strap 62 which remains connected to package back face wall 32 at hinge portion 84. Subpackages 74 and 76 can then be pivoted open about the hinge portion 84 provided by the unseparated section of back face wall 32. When the package is open, supplemental handle strap 62 bridges continuously over the top of the joined subpackages at a position which is intermediate and in between the two subpackages to thereby provide a convenient carrying loop.

In an optional embodiment of the invention, complementary perforation lines 78 and 80 extend only partially across the width dimension of package end walls 42 and 44. When the perforation lines are broken and the package is pivoted open to form subpackages 74 and 76, the unseparated sections of the end walls 42 and 44 stretch and plastically deform during the opening process. The strip of material connected to the unbroken sections of end walls 42 and 44 provide a supplemental strap member 176 which bridges continuously over the top of the pair of subpackages.

In still a further aspect of the invention representatively shown in FIGS. 9A through 9E, the opening means can be provided by a frangible region, such as perforation line 78. In addition, the package can include a pair of supplemental frangible lines, such as supplemental perforation lines 81. The supplemental perforation lines run substantially parallel to perforation lines 78, but have a length which is shorter than perforation lines 78. In the illustrated embodiment, perforation lines 78 extends completely around package 20 to provide a separation into two separate and distinct subpackages and 74 and 76. Each of the supplemental perforation lines 81 extends completely across the primary opening wall provided by package front face wall 22 and may optionally extend at least partially across package end walls 42 and 44. The illustrated embodiment incorporates supplemental perforation lines that extend approximately half-way across the width of each of the end walls. As a result, the appointed package material can be broken or otherwise separated from its attachment to front wall 22 along perforation lines 81 to provide a pair of supplemental handle strap members 176 and 178. The supplemental handle strap members can be suitably folded and repositioned to bridge continuously over the top of the exposed stack arrays in each of the associated subpackages 74 and 76. Accordingly, each of the subpackages will have its own separate supplemental handle strap member for convenient transport.

The shown embodiments of the supplemental regions of frangibility are structured as substantially straight lines of perforations, but other linear and nonlinear patterns and configurations of frangibility may also be employed. In addition, the terminal end regions of supplemental strap sections 176 and 178 may optionally be reinforced with reinforcement sections 180. The reinforcement sections may, for example, be provided by patches of additional material which help maintain the secured integrity between the supplemental strap sections and subpackages 74 and 76.

In the various embodiments of the invention, the package walls and bag components may be composed of different materials, or may be composed of substantially the same type of material. Typically, the material is a polymer film which is sufficiently flexible to assume a desired, generally hexahedral shape when the package is substantially filled with articles. In addition, the material should have sufficient strength to hold and contain the articles without breaking and without excessive bulging or stretching of the film material. Suitable materials include monolayer films and coextruded films, and the various configurations of the bag can be made from tube stock or flat stock material. In the illustrated embodiment, for example, the film material may be composed of a polyethylene film or film laminate having a thickness of about 0.001–0.004 inch ( about 0.025–0.10 millimeters). Particular examples of the film material may comprise a LDPE (low density polyethylene) film, a LDPE/LLDPE (linear low density polyethylene) film laminate, a LDPE/MDPE (medium density polyethylene) film laminate, a LDPE/HDPE (high density polyethylene) film laminate or the like.

Figures 10A, 10B, 10C, 10D:
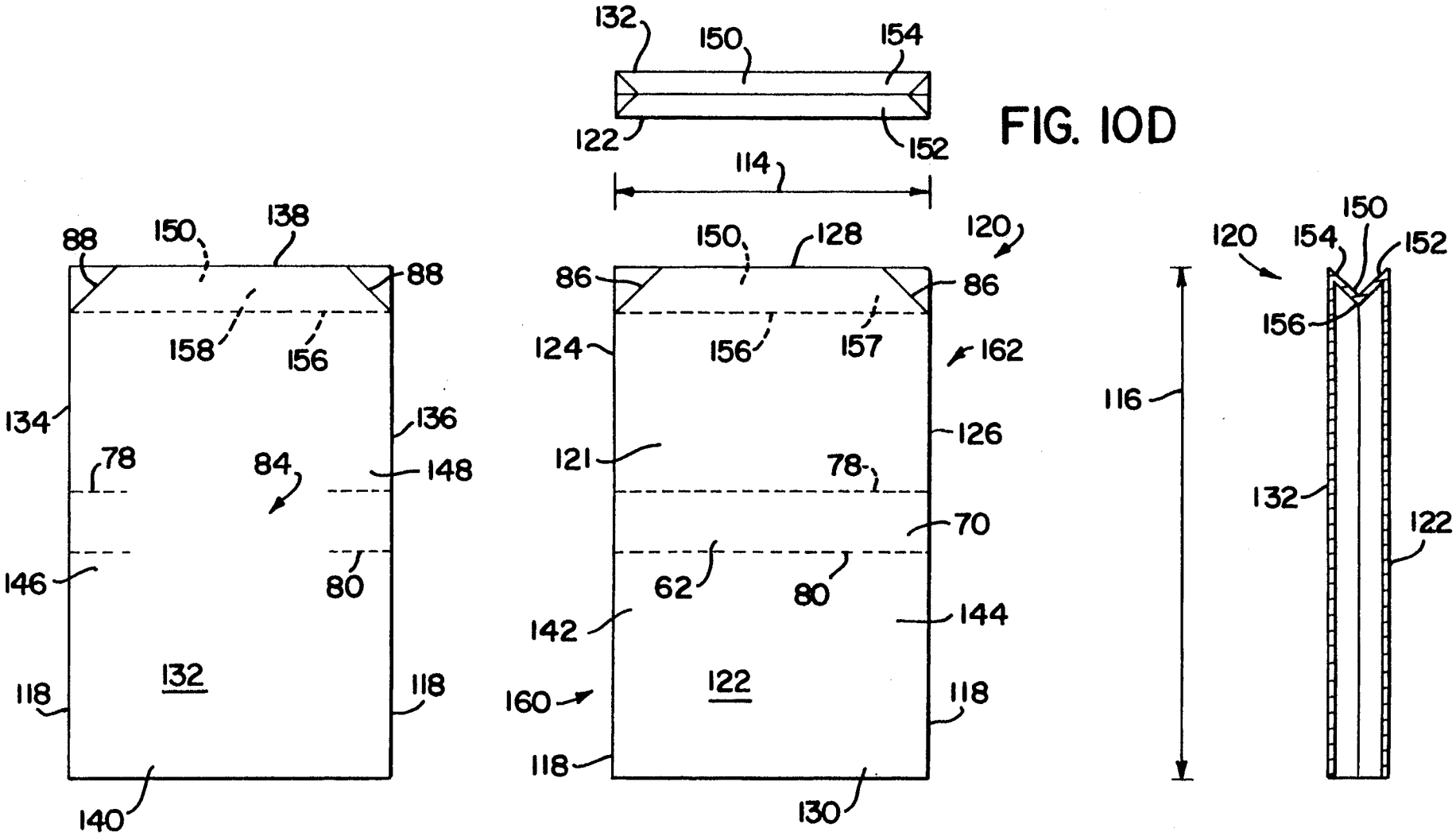
FIG. 10A representatively shows a front view of a bag of the invention having a top gusset member and a single supplemental handle member.
FIG. 10B representatively shows a back view of the bag of FIG. 10A.
FIG. 10C representatively shows a slightly expanded, cross-sectional, side view of the bag of FIG. 10A.
FIG. 10D representatively shows a slightly expanded, top view of the bag of FIG. 10A.

With reference to FIGS. 10A through 10C, a bag 120 is composed of a flexible polymer film material and is arranged to hold a plurality of articles. Bag 120 comprises a bag front panel 122 which defines a top edge region 128, a bottom edge region 130, and two opposed side edge regions 124 and 126 thereof. A bag back panel 132 defines a top edge region 138, a bottom edge region 140, and two opposed side edge regions 134 and 136 thereof which connect to the corresponding side edge regions of bag front panel 122. A bag gusset panel 150 interconnects between the top edge regions 128 and 138 of front panel 122 and back panel 132, respectively. A designated opening means, such as frangible region 70, extends at least partially across one of the front and back panels, and continues therefrom to extend at least partially across another of the front and back panels. The opening means provides for a selected separation of the bag panels and is positioned to provide a dividing line located substantially between separatable, adjacent stacked arrays 92 of articles 94. The opening means thereby provides for a separation of bag 120 into at least a pair of bag subsections 160 and 162. Each subsection is appointed to thereby contain at least a portion of at least one article stack therein, while exposing a region of the at least one article stack for grasping.

Bag 120 provides a containment portion 121 which is appointed to retain a plurality of article stacks 96 (FIG. 2A), where each stack has a pair of opposed facing ends 97 and 98 thereof, and includes a multiplicity of selected articles 94. The containment portion includes an appointed stacking direction 100 along which the article stacks 96 are to be arranged to extend in a generally parallel, side-by-side configuration. The containment portion also includes opposed end panel portions which are appointed for contacting the facing ends of the article stacks. In the illustrated embodiment, the bag front panel 122 includes a bottom region 130 and end panel regions 142 and 144. Bag back panel 132 includes a bottom region 140 and end panel regions 146 and 148.

Bottom panel region 130 and bottom panel region 140 are composed of sufficient material to cooperatively provide bottom wall 56 of package 20 when the bag is assembled into its filled condition. End panel regions 142 and 144 are attached to end panel regions 148 and 146, respectively, along attachment lines 118 by suitable fastening means. The attached end panel regions include sufficient amounts of material to operatively provide package end walls 42 and 44 when the bag is filled. Bag front panel 122 and bag back panel 132 are constructed and arranged to operatively define a bag length 114 and a bag depth 116. It should be readily apparent that the panel length and depth dimensions will vary depending upon the size and the desired configuration of the packaged articles.

With reference to FIGS. 10A and 10B, the shown embodiment of front panel 122 can include two opposed, generally parallel side edge regions 124 and 126. The front panel further includes a top edge region 128 which generally interconnects and runs substantially perpendicular to the side edges. The shown embodiment of back panel 132 includes two opposed, generally parallel side edge regions 134 and 136. The back panel further includes a top edge region 138 which extends substantially perpendicular to side edge regions 134 and 136, and generally interconnects the side edge regions. In the illustrated embodiment, back panel 132 is generally coextensive with front panel 122 and is positioned in an adjacent, facing relation with the front panel. Thus, a major face surface of the back panel is located generally parallel and side-by-side to a major face surface of the front panel. The two, side edge regions 134 and 136 of back panel 132 are suitably interconnected with the correspondingly adjacent side edge regions 126 and 124, respectively, of front panel 122. The interconnecting assembly of the front and back panels may be accomplished by various techniques well known in the art, such as adhesive bonding, thermal bonding, ultrasonic bonding, welding, and the like. Alternatively, the interconnection may be accomplished with interengaging mechanical fastening systems, such as sewing, stapling, riveting, and the like. Similarly, the other component parts of bag 120 described in the present specification can be attached or otherwise connected together employing the above-described assembly techniques. In the illustrated embodiment, back panel 132 and front panel 122 are secured and fused to each other along their respective side edge regions by thermal bonding lines 118.

Bag 120 includes a top panel member, such as top gusset 150, which interconnects between the top edge regions 128 and 138 of the bag front and back panels 122 and 132, respectively. In its extended condition, top gusset 150 provides top wall 50 of package 20. The extended, transverse dimension of the top gusset substantially corresponds to the width of top wall 50 and the width of package 20. In the particular embodiments of the invention, the package width can substantially correspond to the width 99 articles 94. Optionally, the package width can substantially correspond to the depth dimension 101 of the articles, or can substantially correspond to the length dimension 95 of an article stack 96. Bag gusset 150 also includes two opposed side edge regions 152 and 154 thereof. Gusset side region 152 connects to bag front panel 122 and gusset side region 154 connects to back panel 132.

Top gusset 150 may be integrally formed with either of front panel 122 or back panel 132, or may be integrally formed with both the front and back panels. Alternatively, top gusset 150 may be a separate web of material which is assembled to top edge 128 of front panel 122 and top edge 138 of back panel 132. The top gusset is typically composed of a flexible polymer film material, such as the material employed to construct front panel 122 or back panel 132. Alternatively, the material of the top gusset may differ from the material of the front and back panels.

With reference to the embodiment representatively shown in FIG. 10A–10C, top gusset 150 is integrally formed with both front panel 122 and back panel 132. Accordingly, a unitary web of material is selectively folded to form the top gusset and the front and back panels. The top gusset extends from a fold line at top edge 128 to a fold line at top edge 138 and includes a medial fold line 156. The fold line at top edge 128 provides a line of demarcation between front panel 122 and top gusset 150. Similarly, the fold line at top edge 138 provides a line of demarcation between back panel 132 and the top gusset. Medial fold line 156 effectively divides the top gusset into two gusset panel sections 157 and 158. In the illustrated embodiment, fold line 156 extends substantially down the center of top gusset 150, and generally bisects the top gusset to define gusset panel sections 157 and 158, which are substantially equal in size. The top gusset has an unfolded, extended width which substantially corresponds to the desired package width 110 (FIG. 1C).

In an alternative embodiment of the invention where top gusset 150 is a separate member assembled to front panel 122 and back panel 132, the top gusset member may be composed of a material which is different than the material comprising the front and back panels. Upon assembly, the longitudinal, lengthwise edge regions of the top gusset member will be connected by suitable fastening mechanisms to the front and back panels along the top edge regions 128 and 138 thereof.

In particular embodiments of the invention, the panel sections of top gusset 150 may be joined to front panel 122 and back panel 132 with selected groups of diagonally extending lines of attachment. With reference to FIG. 10C, end regions 152, 154 of gusset panel section 157 can be attached to front panel 122 with diagonally extending lines of attachment, such as gusset thermal bonds 86. Similarly, end regions 152, 154 of gusset panel section 158 can be attached to back panel 132 with diagonal thermal bonds 88. The angle and placement of the diagonal bonds are selected and arranged such that the filled package assumes and reliably maintains the desired carton-like appearance. In the representatively shown embodiment, for example, the diagonal bonds have a width of about 0.125 inch (about 0.32 cm), and have a length which is generally aligned at an angle of about 45 degrees downwardly from the horizontal top edges of the front and back panels. In the illustrated embodiment, the downward end of the diagonal bond intersects its respective side panel bond 118 at a point located approximately 0.75 inch above gusset fold line 156. The side panel bond has a width of about 0.375 inch (about 0.952 cm).

In the embodiment shown in FIGS. 10A and 10B, for example, the opening means includes a frangible region 70 which extends across approximately the entire length of front panel 122. The frangible region contiguously continues therefrom to traverse edge bonds 118 and to extend across spaced-apart end edge regions 134 and 136 of back panel 132. Alternatively, frangible region 70 can extend across approximately the entire length of back panel 132, and can contiguously continue therefrom to traverse edge bonds 118 and extend across a pair of spaced-apart side edge regions 124 and 126 of front panel 122. In the illustrated embodiment at each side edge region of back panel 132, frangible region 70 can extend along a distance which is substantially equal to about ½ an effective width dimension of top gusset 150. The effective width dimension of the top gusset is the distance measured between the front and back bag panels when the top gusset is spread out in its unfolded, extended-flat condition.

In optional embodiments, the opening means may include a frangible region 70 which extends across approximately the entire depth of either front panel 122 or back panel 132. The frangible region contiguously continues therefrom to extend partially or completely across top gusset 150, and partially or completely across the bottom region 140 of back panel 132. Alternatively, frangible region 70 can be configured to extend across approximately the entire depth of both front panel 122 and back panel 132, and contiguously continue therefrom to extend at least partially across top gusset 150, and at least partially across the bottom region 130 of front panel 122.

In other optional embodiments of the invention, the opening means can include a frangible region which is aligned generally parallel to the top edge of front panel 122 and extends across a pair of joined side edge regions 124 and 136 of front and back panels 122 and 132, respectively. The opening means continues therefrom to extend only partially across the length of front panel 122 and only partially across the length of back panel 132. In particular, the frangible region is substantially excluded from the joined side edge regions 126 and 134 of front and back panels 122 and 132, respectively.

Alternatively, the opening means can include a frangible region 70 which extends across top gusset 150, and continues therefrom to extend partially across the depth of front panel 122 and partially across the depth of back panel 132. In particular, the frangible region can be substantially excluded from the bottom edge regions 130 and 140 of front and back panels 122 and 132, respectively. In this embodiment, the frangible line region can aligned generally parallel to the side edges of front panel 122.

In particular aspects of the invention, frangible region 70 can extend along a direction generally parallel to the front panel top edge region 128, and extends across at least a portion of each of the front and back bag panels 122, 132. The opening means provides for a selected separation of the bag panels along a selected opening line which is positioned along stacking direction 100 at a location which is appointed for placement intermediate a pair of immediately adjacent article stacks 96a and 96. The opening means thereby provides for a separation of bag 120 into at least a pair of bag subsections 160 and 162 with each subsection appointed to contain at least one complete article stack 95, 96 therein while exposing a side edge portion 102 or 104 of the at least one article stack for grasping.

Figure 11C:
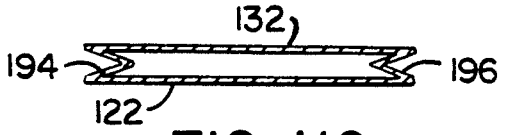
FIG. 11C representatively shows a slightly expanded, cross-sectional, bottom view of the bag of FIG. 11A.
Figure 11B:
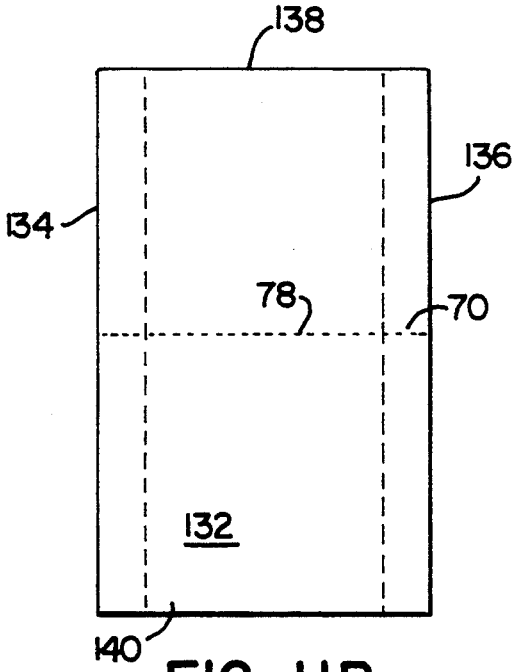
FIG. 11B representatively shows a back view of a bag of FIG. 11A.
Figure 11A:
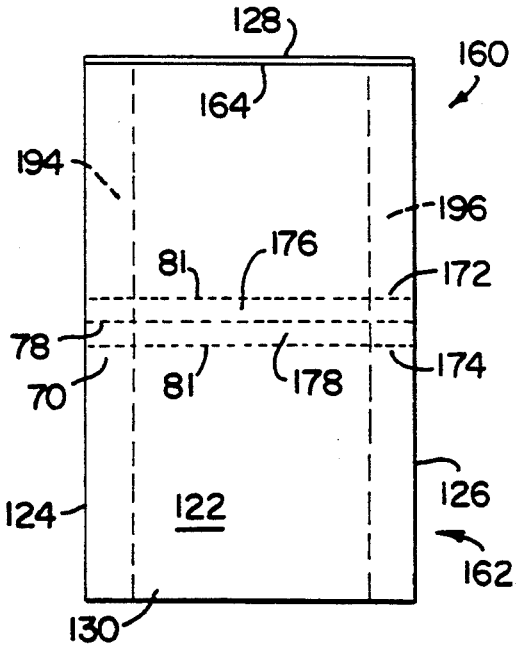
FIG. 11A representatively shows a front view of another bag of the invention having a pair of side gusset members and a pair of supplemental handle members.

A further aspect of the invention, representatively shown in FIGS. 11A through 11C, provides a bag 120 which is constructed of a flexible material and is configured for holding a plurality of articles. The bag includes a bag front panel 122 which defines a top edge region 128, a bottom edge region 130, and two opposed side edge regions 124 and 126 thereof. A bag back panel 132 defines a top edge region 138, a bottom edge region 140, and two opposed side edge regions 134 and 136 thereof. An opposed pair of bag side gusset panels 194 and 196 interconnect between the corresponding side edge regions of bag front and back panels 122 and 132. In the illustrated embodiment, for example, bag side gusset panel 194 interconnects between side edge region 124 of front panel 122 and side edge region 136 of back panel 132. Similarly, bag side gusset panel 196 interconnects between side edge region 126 of bag front panel 122, and side edge region 134 of bag back panel 132. A designated opening means, such as frangible region 70, extends substantially completely across at least one of the front and back panels 122 or 132, respectively, and continues therefrom to extend partially across each of the side gusset panels 194 and 196. The opening means provides for a selected separation of bag 120, and is positioned along the bag front and back panels at a region of the bag which is appointed for placement substantially intermediate two or more separatable, adjacent stacked arrays of articles 94. The opening means thereby provides for a separation of bag 120 into at least a pair of bag subsections 160 and 162. Each bag subsection is appointed to thereby contain at least a portion of at least one article stack therein, while exposing a region of the at least one article stack for grasping.

In the illustrated embodiment of FIGS. 11A and 11B, the top edge of front panel 122 is operably attached to the top edge of back panel 132 along predetermined sections of each panel with suitable fastening means, such as thermal bonding line 164. The construction of each of the side gusset panels 194 and 196 is similar to the construction of top gusset 150 employed by the bag representatively shown in FIG. 10C. Accordingly, the described configurations and arrangements directed to top gusset 150 would also apply to the configurations and arrangements of each of the side gusset panels, except that the side gusset panels operably interconnect the side edges of bag front panel 122 to the side edges of bag back panel 132. It should be appreciated that the various, representatively shown embodiments of the bag can be made from seamless tube stock or flat stock material which has been formed into the shape of a tube by being seamed in one or more places.

Figure 12B:
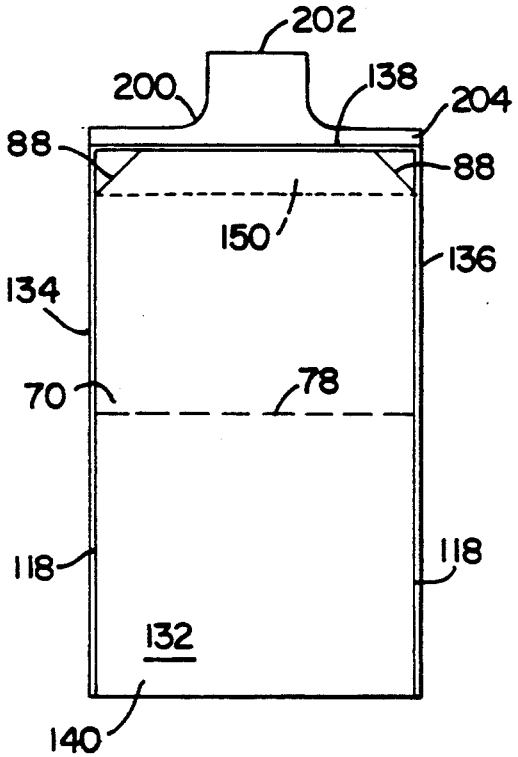
FIG. 12B representatively shows a back view of the bag of FIG. 12A.
Figure 12A:
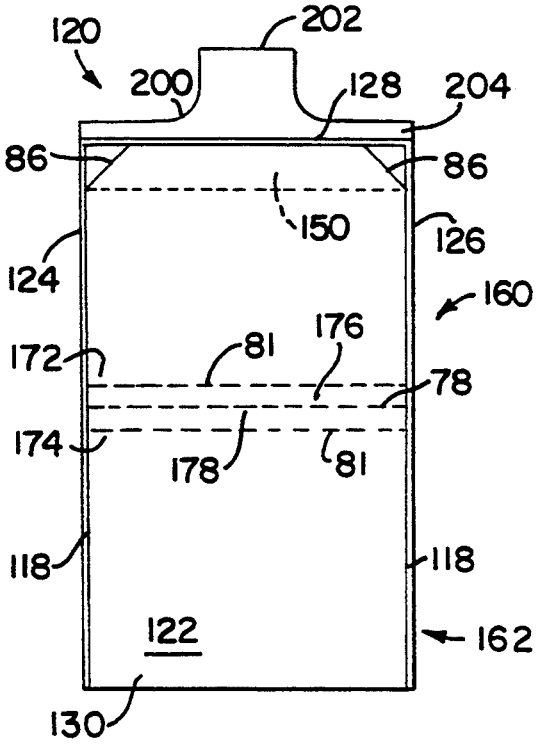
FIG. 12A representatively shows a front view of a bag of the invention having a primary carrying handle and a pair of supplemental handle members.

The various embodiments of bag 120 may additionally include a handle web member which connects to the top edge regions 128 and 138 of the front and back panels 122 and 132, as representatively shown in FIGS. 12A and 12B. Primary handle web 200 has a mounting portion 204 for connecting to the front and back panels, and a strap portion 202 for providing a carrying loop. The carrying loop is constructed to bridge transversely over top gusset 150 and to extend between front panel 122 and back panel 132. The carrying loop can be constructed and arranged to provide for an arm suspension of bag 120 through use of the carrying loop.

In another aspect of the invention, a handle web member 200 may be constructed to bridge longitudinally over top gusset 150 and arranged to extend generally along stack direction 100, as representatively shown in FIGS. 6B and 6C. The mounting portion of handle web 200 connects to longitudinally spaced apart, sections of either or both of the top edge regions 128 and 138 of front and back panels 122 and 132, respectively. A strap portion 202 of handle web 200 provides a suitable carrying loop which is constructed to bridge longitudinally over top gusset 150 and to extend between the appointed, opposed end walls 42 and 44 of a filled package. The carrying loop can advantageously be constructed and arranged to provide for an arm suspension of bag 120.

The handle web is composed of a flexible web material, such as a polymer material composed of a MDPE/LDPE film laminate or a HDPE film, which has sufficient tensile strength and sufficient load capacity to support the weight of a filled bag while the bag is suspended by the handle web. The film material may be composed of a polymer film or film laminate having a thickness of about 0.001–0.004 inch (about 0.025–0.10 millimeters). In the illustrated embodiment, for example, handle web 200 can be composed of a MDPE/LDPE film material having a web thickness of about 0.003 inch (about 0.076 millimeters).

In particular aspects of the invention, the mounting sections of handle 200 can be constructed to extend substantially along the entire length of the top edge regions 128 and 138 of front panel 122 and back panel 132, respectively. As a result, the mounting sections can be attached, for example with adhesive or thermal bonds, along substantially the entire top edge periphery of the filled package. Such a configuration can more widely spread and distribute the carrying stresses induced by using the handle web to transport a filled bag. Optionally, the mounting sections of handle 200 may be bonded along an extent which is less than the entire length of the top edge regions of the front and back panels. Where frangible region 70 traverses a section of the mounting portion of handle 200, the mechanism of frangibility is operably incorporated into the traversed section of the handle web to allow the desired opening of the package.

In particular aspects of the invention, bag 120 can further comprise a supplemental handle member 176 which is connected to bag 120 in a substantially inoperable storage condition, and is activatable to an operable handle strap condition. The supplemental handle member can, for example, be integrally formed with bag front panel 122 or bag back panel 132 when the supplemental handle member is in its storage condition.

In an aspect of the invention representatively shown in FIGS. 10A and 10B, bag 120 includes a supplemental carrying means provided by supplemental strap section 62. In the illustrated embodiment, strap section 62 is defined by a supplemental region of frangibility 80 which extends in a generally parallel, adjacent and spaced relation from frangible line 78. Accordingly, frangible line 80 extends across approximately the entire length of front panel 122, and contiguously continues therefrom to traverse edge bonds 118 and to extend across spaced-apart end edge regions 134 and 136 of back panel 132. At each side edge region of back panel 132, frangible line 80 extends along a distance which is substantially equal to about ½ an effective width dimension of top gusset 150, where the effective width dimension of the top gusset is the distance measured between the front and back bag panels when the top gusset is spread out in its unfolded, extended-flat condition.

In another aspect of the invention representatively shown in FIGS. 11A and 11B, for example, bag 120 includes a supplemental carrying means provided by supplemental strap sections 176 and 178. In the illustrated embodiment, strap section 176 is defined by a supplemental region of frangibility 172, which extends in a generally parallel, adjacent and spaced relation from frangible region 70. Similarly, strap section 178 can be defined by a supplemental region of frangibility 174, which extends in a generally parallel, adjacent and spaced relation from frangible region 70. More particularly, the opening means can be provided by perforation line 78, and the supplemental regions of frangibility can be provided for by a pair of supplemental perforation lines 81. The supplemental perforation lines run substantially parallel to perforation lines 78, but have a length which is shorter than perforation lines 78. In the illustrated embodiment, perforation lines 78 extends completely around bag 120 to provide a separation into two separate and distinct bag subsections 160 and 162. Each of the supplemental perforation lines 81 extends completely across the primary opening wall provided by bag front panel 122, and may optionally extend at least partially across appointed end wall regions provided for by side gussets 194 and 196. The illustrated embodiment, for example, incorporates supplemental perforation lines 81 that extend approximately half-way across the effective, flat-out width dimension of each of the side gusset panels. As a result, the appointed bag material can be broken or otherwise separated from its attachment to front panel 122 along perforation lines 81 to provide a pair of supplemental handle strap members 176 and 178. The supplemental handle strap members can be suitably folded and repositioned to bridge continuously over the top of the exposed stack arrays in each of the associated bag subsections. Accordingly, each of the bag subsections will have its own separate supplemental handle strap member for convenient transport.

In another configuration of the invention representatively shown in FIGS. 12A and 12B, bag 120 includes a primary handle 200 having a strap portion 202 which loops over the top gusset 150 of the bag. The bag also includes a supplemental carrying means provided by supplemental strap sections 176 and 178. The opening means is provided by perforation line 78, and the supplemental regions of frangibility are provided for by a pair of supplemental perforation lines 81. The supplemental perforation lines run substantially parallel to perforation lines 78, but have a length which is shorter than perforation lines 78. More particularly, perforation lines 78 extends completely around bag 120 to provide a separation into two separate and distinct bag subsections 160 and 162. Optionally, perforation line 78 may extend less than completely around the bag. Each of the supplemental perforation lines 81 extends completely across the primary opening wall provided by bag front panel 122, and does not extend into back panel 132.

Figure 13A:
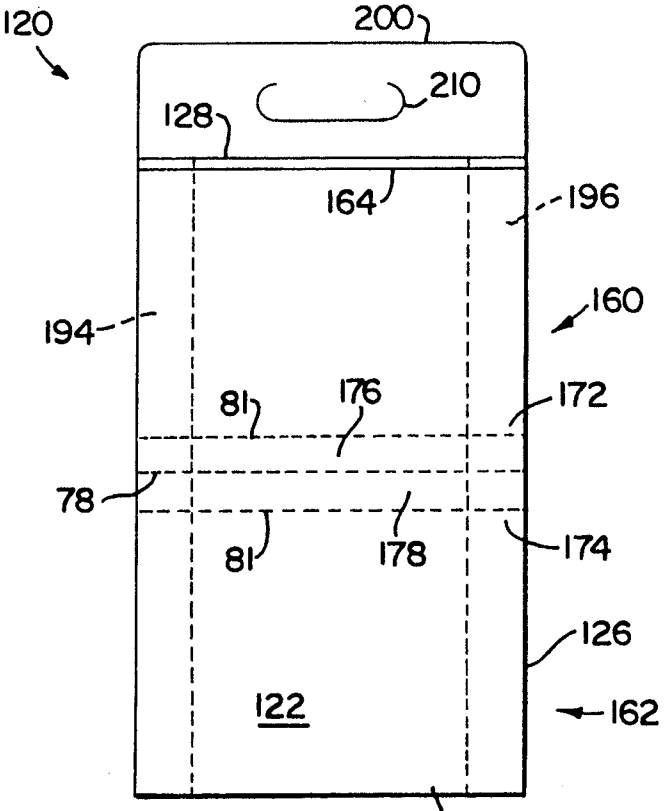
FIG. 13A representatively shows a front view of another bag of the invention having a pair of side gusset members, a primary handle and a pair of supplemental handle members.
Figure 13B:
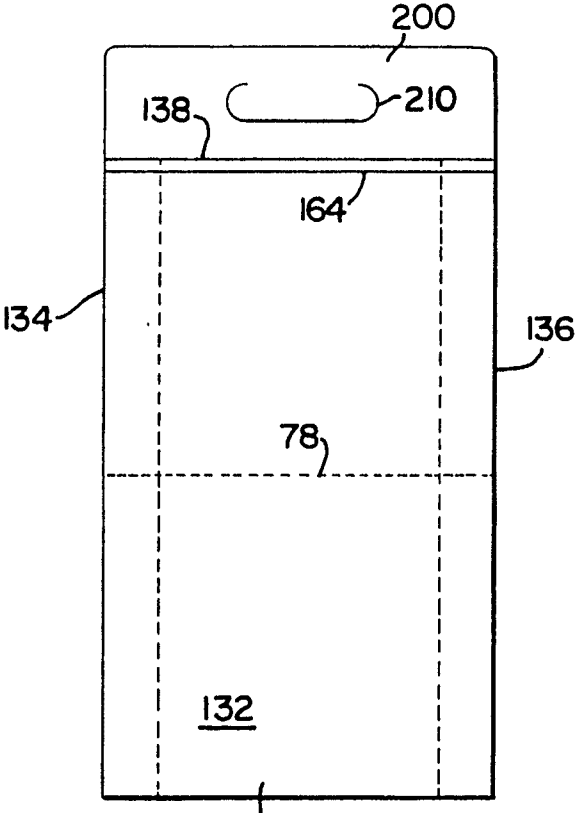
FIG. 13B representatively shows a back view of a bag of FIG. 13A.
Figure 13C:
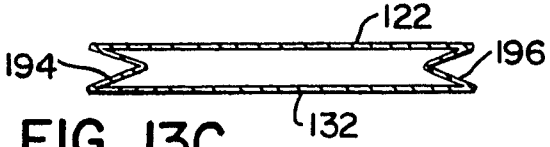
FIG. 13C representatively shows a slightly expanded, cross-sectional, bottom view of the bag of FIG. 13A.

In the configuration of the invention representatively shown in FIGS. 13A–13C, bag 120 includes a an opposed pair of side gusset members 194 and 196, and has a primary handle 200 formed by sections of web material attached to the top edges of front panel 122 and back panel 132. In the illustrated embodiment, the primary handle includes a hand grip opening 210. When filled, the bag can assume a package configuration wherein the primary handle extends from the top of the package (FIGS. 7A–7B). The illustrated configuration of the bag also includes a supplemental carrying means provided by supplemental strap sections 176 and 178. The opening means is provided by perforation line 78, and the supplemental regions of frangibility are provided for by a pair of supplemental perforation lines 81. The supplemental perforation lines run substantially parallel to perforation lines 78, but have a length which is shorter than perforation lines 78. More particularly, perforation line 78 extends completely around bag 120 to provide a separation into two separate and distinct bag subsections 160 and 162. Optionally, perforation line 78 may extend less than completely around the bag. Each of the supplemental perforation lines 81 extends completely across the primary opening wall provided by bag front panel 122, and does not extend into back panel 132. As a result, the supplemental perforations can be selectively activated, when desired, to generate supplemental strap members 176 and 178.

Figure 14B:
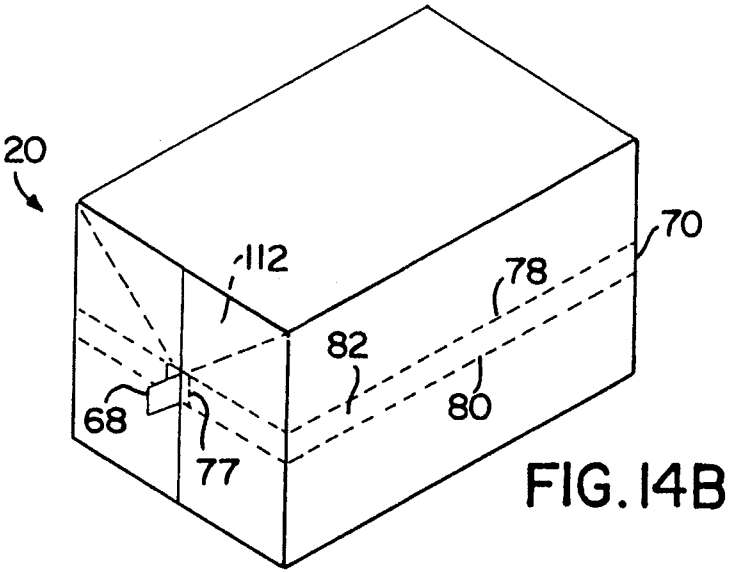
FIG. 14B representatively shows a perspective view of another package of the invention wherein the frangible region includes a separate pull tab member attached to the removable strip formed by the frangible region.
Figure 14C:
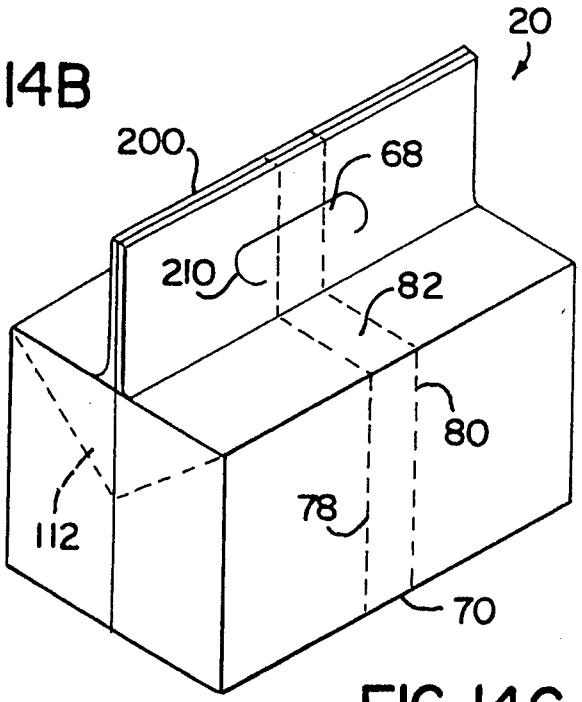
FIG. 14C representatively shows a perspective view of yet another package of the invention wherein the frangible region includes a pull tab region formed by the hand grip opening provided in a primary handle member.
Figure 14A:
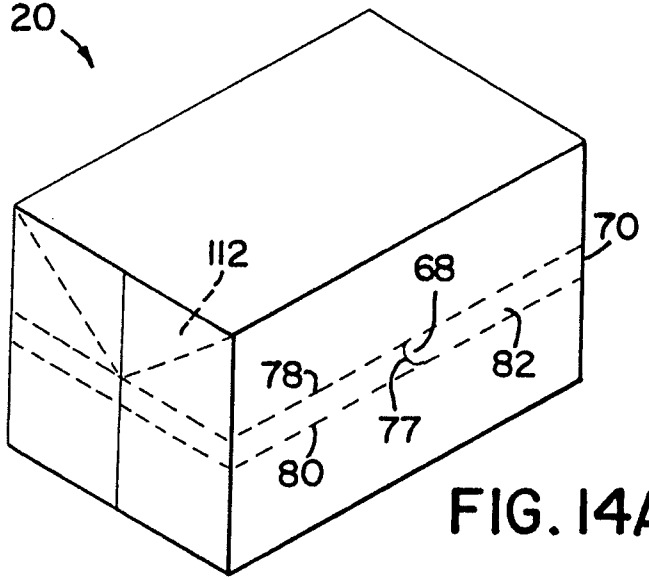
FIG. 14A representatively shows a perspective view of a package of the invention wherein the frangible region includes a pull tab region which is integrally formed from the package material.

In the various configurations of the invention, frangible section 70 can include a pull tab member 68 for facilitating the removal of strip 82, as representatively shown in FIGS. 14A–14C. The pull tab is positioned between frangible lines 78 and 80, and provides a convenient grasping section for applying the desired tearing force to the illustrated perforations. In FIG. 14A, for example, pull tab 68 is integrally formed from the same section of material that provides removable strip 82, and is generated by activating transverse separation line 77. Alternatively, the pull tab can be a separate piece of material assembled to strip region 82 with a suitable attaching mechanism, as representatively shown in FIG. 14B. The separate pull tab can be stored in a position that is flush against the side of the package, and can be selectively lifted away from the package wall for easy grasping. The pull tab is arranged to operably cooperate with transverse separation line 77 to initiate the opening operation. In yet another configuration illustrated in FIG. 14C, pull tab 68 can be provided by a separation line that has another primary purpose. In the shown arrangement, for example, the pull tab 68 can be conveniently formed by the cut-line employed to form hand grip opening 210. The resultant flap of free material can be easily grasped to tear away strip 82 from package 20.

In the various representative embodiments of the invention, the regions of frangibility are structured as substantially straight lines. It should be readily apparent, however, that other curvilinear and nonlinear patterns and configurations of frangibility may also be employed. In addition, the terminal end regions of the various supplemental strap sections may optionally be reinforced. The resultant reinforcement sections may, for example, be provided by patches of additional material which help maintain the secured integrity between the supplemental strap sections and subpackages 74 and 76.

The various bag panels and components may be composed of different materials, or may be composed of substantially the same type of material. Typically, the material is a polymer film which is sufficiently flexible to assume a desired, generally hexahedral shape when the bag is substantially filled with articles. In addition, the material should have sufficient strength to hold and contain the articles without breaking and without excessive bulging or stretching of the film material. The film material may be composed of a polymer film or film laminate having a thickness of about 0.001–0.004 inch (about 0.025–0.10 millimeters). In the illustrated embodiments, for example, the film material may be composed of a polyethylene film or film laminate having a thickness of about 0.0025 inch (about 0.064 millimeters). Examples of the film material may comprise a LDPE (low density polyethylene) film, a LDPE/LLDPE (linear low density polyethylene) film laminate, a LDPE/MDPE (medium density polyethylene) film laminate, a LDPE/HDPE (high density polyethylene) film laminate or the like.

Bag 120 is typically filled through its bottom, and the bottom edge regions of the front and rear panels are folded and suitably bonded to close the bottom of the bag against the bottom portions of the articles in a conventional manner well known to the packaging art. When substantially filled with the articles, the resulting package has a generally hexahedron shape, as representatively shown in FIG. 3A. The closed bottom edge regions of the front and rear bag panels cooperate to provide bottom wall 56 of package 20.

During use of the present invention, stacks 96 can be compressed along stack direction 100 to reduce the length dimension of the completed package. Where articles 94 are resilient, the stack array tends to re-expand along stack direction 100 after the compressed stack of articles has been inserted into bag 120. This tendency to expand is restrained by the package walls, particularly end walls 42 and 44, or top wall 50 and bottom wall 56, in combination with front wall 22 and back wall 32. As a result, the expansion force exerted by the compressed articles applies a tensile stress to the various combinations of the package walls, and the applied stress generates a certain amount of resilient elastic strain or stretch within at least the front and back walls. Accordingly, the bag material is suitably selected and sized to withstand and accommodate the stresses and strains produced by the expansive forces generated during the package filling process and by the compressed stacks contained within the filled package. Preferably, the bag material is selected and sized such that it does not undergo excessive amounts of permanent, plastic deformation when stressed by the stacked array. Medial portions of front panel 122 and back panel 132 form package front and back walls 22 and 32, respectively. Longitudinal end regions 142, 144 of front panel 122 and longitudinal end regions 148, 146 of back panel 32 form package end walls 42 and 44 with the bonding lines of attachment 118 running along the end walls and along the depth dimension of the filled package.

Figure 6A:
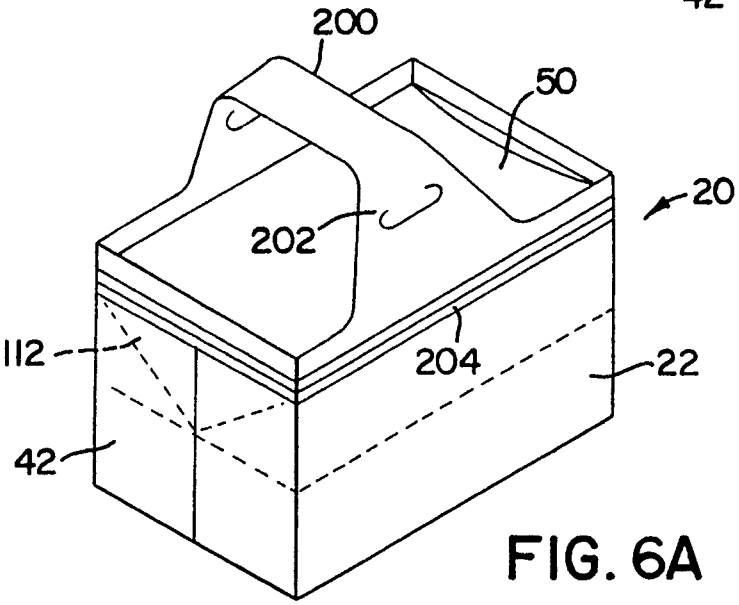
FIG. 6A representatively shows an aspect of the invention having a primary carrying handle which bridges transversely over the package top and is attached to a top edge perimeter of the package.

Top gusset member 150 becomes extended with the medial portion of the top gusset forming package top wall 50. As bag 120 is filled with articles, longitudinal end regions of top gusset 150 become folded and tucked into the interior of the package to form generally triangular-shaped tucks 112 (FIGS. 6A–6C). Where diagonal bonds 86 and 88 are employed to secure selected portions of top gusset 150 to front panel 122 and back panel 132, tucks 112 are securely held against package end walls 42 and 44. As a result, the contained articles are substantially prevented from migrating into the space between tuck 112 and package end walls 42 and 44. Such migration could undesirably distort the package shape, inhibit efficient stacking of the filled packages, and degrade the aesthetic appearance of the packages when displayed on retail shelves.

Thus, bag 120 can advantageously provide an improved package 20 which is composed of flexible material and contains a substantially stacked array 96 of compressed articles. The filled bag package comprises a front wall panel which has a top edge region and has an appointed lengthwise stack direction 100. Stacked array 96 extends substantially along the stack direction, and articles 94 are at least temporarily compressed along the stack direction when contained within the package.

It should be readily apparent that the various shown embodiments of the package or bag of the invention may be combined with any of the various alignments and configurations of the opening means described herein. Similarly, the various disclosed embodiments of the invention may be combined with any of the primary handle structures and/or any of the supplemental handle or strap structures described herein.

Having thus described the invention in rather full detail, it will be readily apparent that various changes and modifications may be made without departing from the spirit of the invention. All of such changes and modifications are contemplated as being within the scope of the invention, as defined by the subjoined claims.

We claim:

1. A package, which is composed of a flexible polymer material and contains a plurality of articles, comprising:

a front face wall defining a top edge region, a bottom edge region and two opposed side edge regions thereof;

a back face wall defining a top edge region, a bottom edge region and two opposed side edge regions thereof;

a top wall which interconnects between the top edge regions of said front and back walls, and includes a pair of oppositely located side edge regions thereof;

a bottom wall which interconnects between the bottom edge regions of said front and back walls and includes a pair of oppositely located side edge regions thereof;

two oppositely located end walls each of which interconnects between a side edge region of said front wall and a side edge region of said back wall, and interconnects between a side edge region of said top wall and a side edge region of said bottom wall;

a plurality of stacks of said articles contained within said package, said article stacks arranged to extend in a generally parallel, side-by-side configuration with each stack including a multiplicity of said articles, each of said stacks aligned along an appointed stacking direction of said package, and each of said stacks having opposed facing ends thereof contacting opposed walls of said package, thereby identifying said contacted opposed walls as appointed abutment walls of said package;

a designated opening means which extends across a selected primary opening wall of said package and extends at least partially across each of a pair of oppositely located, complementary opening walls of said package, said opening means providing for a selected separation of said primary and complementary opening walls, and said opening means positioned along said primary and complementary opening walls at a location which is positioned substantially between separable, immediately adjacent arrays of stacked articles, thereby providing for a separation of said package into at least a pair of subpackages, with each subpackage containing at least a portion of at least one article stack therein while exposing a portion of said at least one article stack for grasping; and at least one supplemental handle member connected to said package in a substantially inoperable storage condition and activatable to an operable handle condition, said at least one supplemental handle member integrally formed with said front wall or said back wall when said at least one supplemental handle member is in its storage condition and provided by a supplemental frangible line which runs substantially parallel to said designated opening means, said at least one supplemental handle member thereby activatable to bridge over said exposed article stack portion.

2. A package as recited in claim 1, wherein said opening means positioned along said primary and complementary opening walls at a location which is generally parallel to said stacking direction and is positioned substantially between a pair of immediately adjacent article stacks, thereby providing for a separation of said package into at least a pair of subpackages, with each subpackage containing at least one complete article stack therein while exposing a side portion of said at least one article stack.

3. A package as recited in claim 1, wherein said opening means positioned along said primary and complementary opening walls at a location which is generally perpendicular to said stacking direction, thereby providing for a separation of said package into at least a pair of subpackages, with each subpackage containing at least one of said arrays of stacked articles therein while exposing a portion of said at least one array of articles.

4. A package as recited in claim 1 wherein said primary opening wall is one of said package face walls, and said complementary opening walls are said package end walls.

5. A package as recited in claim 1 wherein said primary opening wall is one of said end walls, and said complementary opening walls are said front and back face walls.

6. A package as recited in claim 1 wherein said primary opening wall is said bottom wall, and said complementary opening walls are said front and back face walls.

7. A package as recited in claim 1 wherein said primary opening wall is said top wall, and said complementary opening walls are said front and back face walls.

8. A package as recited in claim 1, wherein said opening means has an extent which leaves an unseparated hinge portion, and wherein said at least one supplemental handle member is activatable to form a strap connected to said package at said hinge portion.

9. A package as recited in claim 1, wherein a plurality of supplemental handle members are provided by supplemental frangible lines which run substantially parallel to said designated opening means and each supplemental frangible line having a length shorter than a length of said opening means, and wherein at least one supplemental handle member connects to each of said subpackages.

10. A bag composed of a flexible polymer material for holding a plurality of articles, said bag comprising:

a bag front panel defining a top edge region, a bottom edge region and two opposed side edge regions thereof;

a bag back panel defining a top edge region, a bottom edge region and two opposed side edge regions thereof which connect to said side edge regions of said front panel;

a bag gusset panel which interconnects between the top edge regions of said front and back panels;

a designated opening means which extends at least partially across one of said front and back panels and continues therefrom to extend at least partially across another of said front and back panels, wherein said opening means provides for a selected separation of said bag panels and is positioned to provide a dividing line located substantially between separable, adjacent stacked arrays of said articles, thereby providing for a separation of said bag into at least a pair of bag subsections, with each subsection appointed to thereby contain at least a portion of at least one article stack therein while exposing a region of said at least one article stack for grasping; and at least one supplemental handle member connected to said bag in a substantially inoperable storage condition and activatable to an operable handle condition, said at least one supplemental handle member integrally formed with said bag front panel or said bag back panel when said at least one supplemental handle member is in its storage condition and provided by a supplemental frangible line which runs substantially parallel to said designated opening means, said at least one supplemental handle member thereby activatable to bridge over said exposed article stack region.

11. A bag as recited in claim 10, wherein at least a portion of said opening means is aligned with an appointed bag stacking direction, and said opening means provides for a selected separation of said bag panels along a region of said bag which is appointed for placement substantially intermediate a pair of immediately adjacent article stacks, thereby providing for a separation of said bag into at least a pair of appointed bag subsections, with each subsection appointed to contain at least one complete article stack therein while exposing a side portion of said at least one article stack.

12. A bag as recited in claim 10, wherein said designated opening means extends at least partially across each of said front and back panels and continues therefrom to extend substantially completely across said bag gusset panel.

13. A bag as recited in claim 10, wherein said designated opening means extends substantially completely across one of said front and back panels and continues therefrom to extend partially across another of said front and back panels along selected portions of said other panel.

14. A bag as recited in claim 10, wherein said opening means has an extent which leaves an unseparated hinge portion, and wherein said at least a supplemental handle member is activatable to form a strap connected to said bag at said hinge portion.

15. A bag as recited in claim 10 wherein a plurality of supplemental handle members are provided by supplemental frangible lines which run substantially parallel to said designated opening means and each supplemental frangible line having a length shorter than a length of said opening means, and wherein at least one supplemental handle member connects to each of said bag subsections.

16. A bag composed of a flexible polymer material for holding a plurality of articles, said bag comprising:

a bag front panel defining a top edge region, a bottom edge region and two opposed side edge regions thereof;

a bag back panel defining a top edge region, a bottom edge region and two opposed side edge regions thereof;

an opposed pair of bag side gusset panels which interconnect between the side edge regions of said front and back panels;

a designated opening means which extends across at least one of said front and back panels and continues therefrom to extend at least partially across each of said side gusset panels, said opening means providing for a selected separation of said bag, and said opening means positioned along said bag panels at a region which is appointed for placement substantially intermediate a pair of adjacent stacked arrays of said articles, thereby providing for a separation of said bag into at least a pair of appointed bag subsections, with each subsection appointed to contain at least a portion of at least one complete article stack therein while exposing a region of said at least one article stack for grasping; and at least one supplemental handle member connected to said bag in a substantially inoperable storage condition and activatable to an operable handle condition, said at least one supplemental handle member integrally formed with said front panel or said back panel when said at least one supplemental handle member is in its storage condition and provided by a supplemental frangible line which runs substantially parallel to said designated opening means, said at least one supplemental handle member thereby activatable to bridge over said exposed article stack region.

17. A bag as recited in claim 16, wherein at least a portion of said opening means is aligned with an appointed bag stacking direction, and said opening means provides for a selected separation of said bag panels along a region of said bag which is appointed for placement substantially intermediate a pair of immediately adjacent article stacks, thereby providing for a separation of said bag into at least a pair of appointed bag subsections, with each subsection appointed to contain at least one complete article stack therein while exposing a side portion of said at least one article stack.

18. A bag as recited in claim 16, wherein at least a portion of said opening means is aligned generally perpendicular to an appointed bag stacking direction, and said opening means provides for a selected separation of said bag panels along a region of said bag which is appointed for placement substantially intermediate a pair of immediately adjacent article stacks, thereby providing for a separation of said bag into at least a pair of appointed bag subsections, with each subsection appointed to contain at least one of said arrays of stacked articles therein while exposing a side portion of said at least one array of articles.

19. A bag as recited in claim 16, wherein said designated opening means extends at least partially across one of said front and back panels and continues therefrom to extend substantially completely across each of said side gusset panels.

20. A bag as recited in claim 16, wherein said designated opening means extends substantially completely across one of said front and back panels and continues therefrom to extend partially across another of said front and back panels along selected portions of said other panel.

21. A bag as recited in claim 16, wherein said opening means has an extent which leaves an unseparated hinge portion, and wherein said at least one supplemental handle member is activatable to form a strap connected to said bag at said hinge portion.

22. A bag as recited in claim 16, wherein a plurality of supplemental handle members are provided by supplemental frangible lines which run substantially parallel to said designated opening means and each supplemental frangible line having a length shorter than a length of said opening means, and wherein at least one supplemental handle member is connected to each of said bag subsections.

* * * * *